US008321208B2

(12) United States Patent
Tamura et al.

(10) Patent No.: US 8,321,208 B2
(45) Date of Patent: Nov. 27, 2012

(54) SPEECH PROCESSING AND SPEECH SYNTHESIS USING A LINEAR COMBINATION OF BASES AT PEAK FREQUENCIES FOR SPECTRAL ENVELOPE INFORMATION

(75) Inventors: Masatsune Tamura, Kanagawa-ken (JP); Katsumi Tsuchiya, Kanagawa-ken (JP); Takehiko Kagoshima, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1028 days.

(21) Appl. No.: 12/327,399

(22) Filed: Dec. 3, 2008

(65) Prior Publication Data

US 2009/0144053 A1 Jun. 4, 2009

(30) Foreign Application Priority Data

Dec. 3, 2007 (JP) ..... 2007-312336

(51) Int. Cl.
*G10L 13/06* (2006.01)
*G10L 19/02* (2006.01)

(52) U.S. Cl. ..... 704/205; 704/207; 704/220; 704/258; 704/268

(58) Field of Classification Search ..... 704/200.1, 704/203, 204, 205, 207, 229, 230, 258, 260, 704/268, 220
See application file for complete search history.

(56) References Cited

U.S. PATENT DOCUMENTS 5,195,137 A * 3/1993 Swaminathan ..... 704/222
5,245,662 A * 9/1993 Taniguchi et al. ..... 704/219
5,384,891 A * 1/1995 Asakawa et al. ..... 704/220
5,553,193 A * 9/1996 Akagiri ..... 704/200.1
5,826,232 A * 10/1998 Gulli ..... 704/267
5,890,107 A * 3/1999 Shibuya ..... 704/205
6,081,781 A * 6/2000 Tanaka et al. ..... 704/268

(Continued)

FOREIGN PATENT DOCUMENTS

JP 11-202883 7/1999

(Continued)

OTHER PUBLICATIONS

Yoshitaka Nishimura, et al., "Noise-robust speech recognition using band-dependent weighted likelihood", Technical Report of the Institute of Electronics, Information and Communication Engineers, NLC2003-53, SP2003-116, Dec. 2003, pp. 19-24.

*Primary Examiner* — Martin Lerner
(74) *Attorney, Agent, or Firm* — Oblon, Spivak, McClelland, Maier & Neustadt, L.L.P.

(57) ABSTRACT

An information extraction unit extracts spectral envelope information of L-dimension from each frame of speech data by discrete Fourier transform. The spectral envelope information is represented by L points. A basis storage unit stores N bases (L>N>1). Each basis is differently a frequency band having a maximum as a peak frequency in a spectral domain having L-dimension. A value corresponding to a frequency outside the frequency band along a frequency axis of the spectral domain is zero. Two frequency bands of which two peak frequencies are adjacent along the frequency axis partially overlap. A parameter calculation unit minimizes a distortion between the spectral envelope information and a linear combination of each basis with a coefficient for each of L points of the spectral envelope information by changing the coefficient, and sets the coefficient of each basis from which the distortion is minimized to a spectral envelope parameter of the spectral envelope information.

14 Claims, 27 Drawing Sheets

U.S. PATENT DOCUMENTS

| | | | | |
|---|---|---|---|---|
| 6,275,796 | B1 * | 8/2001 | Kim et al. | 704/230 |
| 6,725,190 | B1 * | 4/2004 | Cohen et al. | 704/205 |
| 7,010,488 | B2 * | 3/2006 | van Santen et al. | 704/258 |
| 7,035,791 | B2 * | 4/2006 | Chazan et al. | 704/207 |
| 7,580,839 | B2 * | 8/2009 | Tamura et al. | 704/258 |
| 7,630,896 | B2 * | 12/2009 | Tamura et al. | 704/258 |
| 7,634,400 | B2 * | 12/2009 | Averty et al. | 704/205 |
| 7,650,279 | B2 * | 1/2010 | Hiekata et al. | 704/205 |
| 8,010,362 | B2 * | 8/2011 | Tamura et al. | 704/265 |
| 2004/0199381 | A1 * | 10/2004 | Sorin | 704/207 |
| 2005/0137870 | A1 | 6/2005 | Mizutani et al. | |
| 2006/0064299 | A1 * | 3/2006 | Uhle et al. | 704/212 |
| 2007/0073538 | A1 * | 3/2007 | Rifkin | 704/236 |
| 2009/0182555 | A1 * | 7/2009 | Chang et al. | 704/201 |
| 2010/0049522 | A1 * | 2/2010 | Tamura et al. | 704/264 |

FOREIGN PATENT DOCUMENTS

| | | |
|---|---|---|
| JP | 2005-164749 | 6/2005 |

* cited by examiner

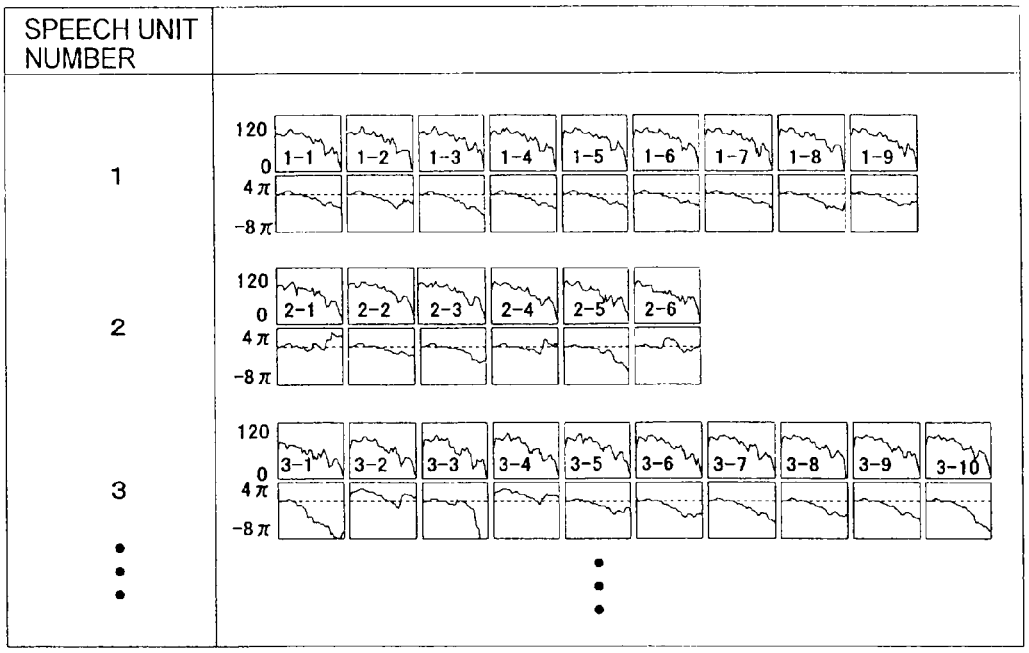
FIG. 30
| SPEECH UNIT NUMBER | PHONEME NAME | FUNDAMENTAL FREQUENCY(Hz) | PHONEME DURATION (msec) | CONCATENATION BOUNDARY CEPSTRUM |
|---|---|---|---|---|
| 1 | /a-LEFT/ | 308.6 | 56.1 | $\mathbf{c}_1(1), \mathbf{c}_1(T)$ |
| 2 | /a-LEFT/ | 300.5 | 36.5 | $\mathbf{c}_2(1), \mathbf{c}_2(T)$ |
| 3 | /a-LEFT/ | 334.6 | 54.2 | $\mathbf{c}_3(1), \mathbf{c}_3(T)$ |
| : | : | : | : | : |
FIG. 31
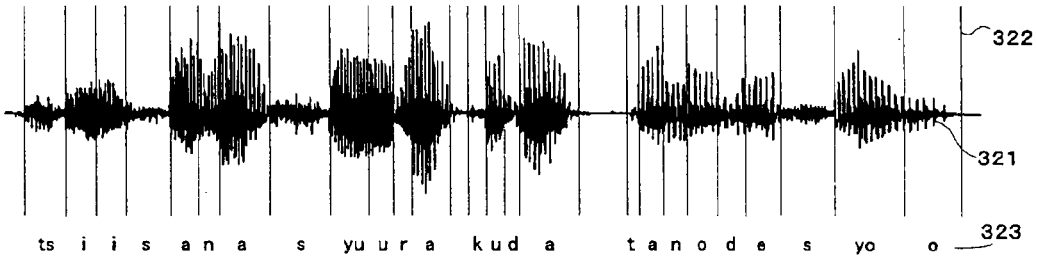
FIG. 32

SPEECH PROCESSING AND SPEECH SYNTHESIS USING A LINEAR COMBINATION OF BASES AT PEAK FREQUENCIES FOR SPECTRAL ENVELOPE INFORMATION

CROSS-REFERENCE TO RELATED APPLICATIONS

This application is based upon and claims the benefit of priority from Japanese Patent Application No. 2007-312336, filed on Dec. 3, 2007; the entire contents of which are incorporated herein by reference.

FIELD OF THE INVENTION

The present invention relates to a speech processing apparatus for generating a spectral envelope parameter from a logarithm spectrum of speech and a speech synthesis apparatus using the spectral envelope parameter.

BACKGROUND OF THE INVENTION

An apparatus for synthesizing a speech waveform from a phoneme/prosodic sequence (obtained from an input sentence) is called "a text to speech synthesis apparatus". In general, the text to speech synthesis apparatus includes a language processing unit, a prosody processing unit, and a speech synthesis unit. In the language processing unit, the input sentence is analyzed, and linguistic information (such as a reading, an accent, and a pause position) is determined. In the prosody processing unit, from the accent and the pause position, a fundamental frequency pattern (representing a voice pitch and an intonation change) and phoneme duration (representing duration of each phoneme) are generated as prosodic information. In the speech synthesis unit, the phoneme sequence and the prosodic information are input, and the speech waveform is generated.

As one speech synthesis method, a speech synthesis based on unit selection is widely used. With regard to the speech synthesis based on unit selection, as to each segment divided from an input text by a synthesis unit, a speech unit is selected using a cost function (having a target cost and a concatenation cost) from a speech unit database (storing a large number of speech units), and a speech waveform is generated by concatenating selected speech units. As a result, a synthesized speech having naturalness is obtained.

Furthermore, as a method for raising stability of the synthesized speech (without discontinuity occurred from the synthesized speech based on unit selection), a speech synthesis apparatus based on plural unit selection and fusion is disclosed in JP-A No. 2005-164749 (KOKAI).

With regard to the speech synthesis apparatus based on plural unit selection and fusion, as to each segment divided from the input text by a speech synthesis, a plurality of speech units is selected from the speech unit database, and the plurality of speech units is fused. By concatenating the fused speech units, a speech waveform is generated.

As a fusion method, for example, a method for averaging a pitch-cycle waveform is used. As a result, a synthesized speech having high quality (naturalness and stability) is generated.

In order to execute speech processing using spectral envelope information of speech data, various spectral parameters (representing spectral envelope information as a parameter) are proposed. For example, linear prediction coefficient, cepstrum, mel cepstrum, LSP (Line Spectrum Pair), MFCC (mel frequency cepstrum coefficient), parameter by PSE (Power Spectrum Envelope) analysis (Refer to JP-A No. H11-202883 (KOKAI)), parameter of amplitude of harmonics used for sine wave synthesis such as HNM (Harmonics Plus noise model), parameter by Mel Filter Bank (refer to "Noise-robust speech recognition using band-dependent weighted likelihood", Yoshitaka Nishimura, Takahiro Shinozaki, Koji Iwano, Sadaoki Furui, December 2003, SP2003-116, pp. 19-24, IEICE technical report), spectrum obtained by discrete Fourier transform, and spectrum by STRAIGHT analysis, are proposed.

In case of representing spectral information by a parameter, necessary characteristic of the spectral information is different for use. In general, the parameter is desired not to be affected by fine structure of spectrum (caused by influence of harmonics). In order to execute statistic processing, spectral information of speech frame (extracted from a speech waveform) is desired to be effectively represented with high quality by a constant (few) dimension number. Accordingly, a source filter model is assumed, and coefficients of a vocal tract filter (a sound source characteristic and a vocal tract characteristic are separated) are used as a spectral parameter (such as linear prediction coefficient or a cepstrum coefficient). In case of vector-quantization, as a parameter to solve stability problem of filter, LSP is used.

Furthermore, in order to reduce information quantity of parameter, a parameter (such as mel cepstrum or MFCC) corresponding to non-linear frequency scale (such as mel scale or bark scale) which the hearing characteristic is taken into consideration is well used.

As a desired characteristic for a spectral parameter used for speech synthesis, three points, i.e., "high quality", "effective", "easy execution of processing corresponding to band", are necessary.

The "high quality" means, in case of representing a speech by a spectral parameter and synthesizing a speech waveform from the spectral parameter, that the hearing quality does not drop, and the parameter can be stably extracted without influence of fine structure of spectrum.

The "effective" means that a spectral envelope can be represented by few dimension number or few information quantity. In other words, in case of operation of statistic processing, the operation can be executed by few processing quantity. Furthermore, in case of storing a storage such as a hard disk or a memory, the spectral envelope can be stored with few capacity.

The "easy execution of processing corresponding to band" means that each dimension of parameter represents fixed local frequency band, and an outline of spectral envelope is represented by plotting each dimension of parameter. As a result, processing of band-pass filter is executed by a simple operation (a value of each dimension of parameter is set to "zero"). Furthermore, in case of averaging parameters, special operation such as mapping of the parameters on a frequency axis is unnecessary. Accordingly, by directly averaging the value of each dimension, average processing of the spectral envelope can be easily realized.

Furthermore, different processing can be easily executed to a high band and a low band compared with a predetermined frequency. Accordingly, as to the speech synthesis based on plural units selection and fusion method, in case of fusing speech units, the low band can attach importance to stability and the high band can attach importance to naturalness. From these three viewpoints, above-mentioned spectral parameters are respectively considered.

As to "linear prediction coefficient", an autoregression coefficient of the speech waveform is used as a parameter.

Briefly, it is not a parameter of frequency band, and processing corresponding to band cannot be easily executed.

As to "cepstrum or mel cepstrum", a logarithm spectrum is represented as a coefficient of sine wave basis on a linear frequency scale or non linear mel scale. However, each basis is located all over the frequency band, and a value of each dimension does not represent a local feature of the spectrum. Accordingly, processing corresponding to the band cannot be easily executed.

"LSP coefficient" is a parameter converted from the linear prediction coefficient to a discrete frequency. Briefly, a speech [0018] "LSP coefficient" is a parameter converted from the linear prediction coefficient to a discrete frequency. Briefly, a speech spectrum is represented as a density of location of the frequency, which is similar to a formant frequency. Accordingly, same dimensional value of LSP is not always assigned with a closed frequency, the dimensional value, and an adaptive averaged envelope is not always determined. As a result, processing corresponding to the band cannot be easily executed. is represented as a density of location of the frequency, which is similar to a formant frequency. Accordingly, same dimensional value of LSP is not always assigned with a closed frequency, the dimensional value, and an adaptive averaged spectral envelope is not always determined. As a result, processing corresponding to the band cannot be easily executed.

"MFCC" is a parameter of cepstrum region, which is calculated by DCT (Discrete Cosine Transform) of a mel filter bank. In the same way as the cepstrum, each basis is located all over the frequency band, and a value of each dimension does not represent a local feature of the spectrum. Accordingly, processing corresponding to the band cannot be easily executed.

As to a feature parameter by PSE model disclosed in JP-A No.H11-202883 (KOKAI), a logarithm power spectrum is sampled at each position of integral number times of fundamental frequency. The sampled data sequence is set as a coefficient for cosine series of M term, and weighted with the hearing characteristic.

The feature parameter disclosed in JP-A No.H11-202883 (KOKAI) is also a parameter of cepstrum region. Accordingly, processing corresponding to the band cannot be easily executed. Furthermore, as to the above-mentioned sampled data sequence, and a parameter sampled from a logarithm spectrum (such as amplitude of harmonics for sine wave synthesis) at each position of integral number times of fundamental frequency, a value of each dimension of the parameter does not represent a fixed frequency band. In case of averaging a plurality of parameters, a frequency band corresponding to each dimension is different. Accordingly, envelopes cannot be averaged by averaging the plurality of parameters.

In the same way, as to parameter of PSE analysis, the above-mentioned sampled data sequence and an amplitude parameter of harmonics used for sine wave synthesis (such as HMM), processing corresponding to the band cannot be easily executed.

In JP-A No. 2005-164749 (KOKAI), in case of calculating MFCC, a value obtained by the mel filter bank is used as a feature parameter without DCT, and applied to a speech recognition.

As to the feature parameter by the mel filter bank, a power spectrum is multiplied with a triangular filter bank so that the power spectrum is located at an equal interval on the mel scale. A logarithm value of power of each band is set as the feature parameter.

As to the coefficient of the mel filter bank, a value of each dimension represents a logarithm value of power of fixed frequency band, and processing corresponding to the band can be easily executed. However, regeneration of a spectrum of speech data by synthesizing the spectrum from the parameter is not taken into consideration. Briefly, this coefficient is not a parameter on the assumption that a logarithm envelope is modeled as a linear combination of basis and coefficient, i.e., not a high quality parameter. Actually, coefficients of the mel filter bank does not often have sufficient fitting ability to a valley part of the logarithm spectrum. In case of synthesizing a spectrum from coefficients of the mel filter bank, sound quality often drops.

As to a spectrum obtained by the discrete Fourier transform or the STRAIGHT analysis, processing corresponding to the band can be easily executed. However, these spectra have the number of dimension larger than a window length for analyzing speech data, i.e., ineffective.

Furthermore, the spectrum obtained by the discrete Fourier transform often includes fine structure of spectrum. Briefly, this spectrum is not always a high quality parameter.

As mentioned-above, various spectral envelope parameters are proposed. However, the spectral envelope parameter having three points ("high quality", "effective", "easy execution of processing corresponding to band") necessary for speech synthesis is not considered yet.

SUMMARY OF THE INVENTION

The present invention is directed to a speech processing apparatus for realizing "high quality", "effective", and "easy execution of processing corresponding to band" by modeling the logarithm spectral envelope as a linear combination of local domain basis.

According to an aspect of the present invention, there is provided an apparatus for a speech processing, comprising: a frame extraction unit configured to extract a speech signal in each frame; an information extraction unit configured to extract a spectral envelope information of L-dimension from each frame, the spectral envelope information not having a spectral fine structure; a basis storage unit configured to store N bases (L>N>1), each basis being differently a frequency band having a maximum as a peak frequency in a spectral domain having L-dimension, a value corresponding to a frequency outside the frequency band along a frequency axis of the spectral domain being zero, two frequency bands of which two peak frequencies are adjacent along the frequency axis partially overlapping; and a parameter calculation unit configured to minimize a distortion between the spectral envelope information and a linear combination of each basis with a coefficient by changing the coefficient, and to set the coefficient of each basis from which the distortion is minimized to a spectral envelope parameter of the spectral envelope information.

BRIEF DESCRIPTION OF THE DRAWINGS

FIG. 30 is an exemplary speech unit data stored in a speech unit storage unit in FIG. 28.

FIG. 31 is an exemplary phoneme environment data stored in a phoneme environment storage unit in FIG. 28.

FIG. 32 is a schematic diagram to explain procedure to obtain speech units from speech data.

DETAILED DESCRIPTION OF THE EMBODIMENTS

Figure 1:
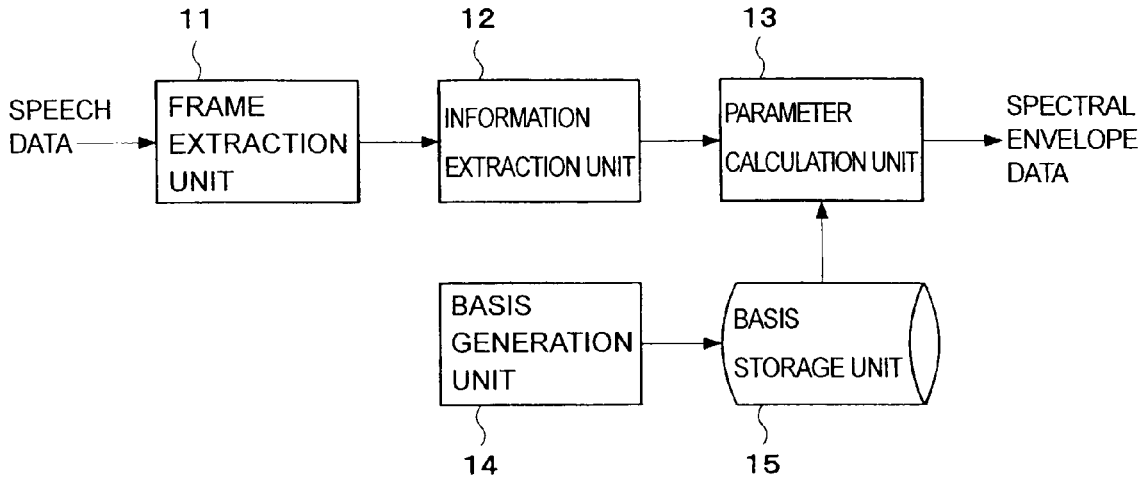
FIG. 1 is a block diagram of a spectral envelope parameter generation apparatus according to a first embodiment.

Hereinafter, embodiments of the present invention will be explained by referring to the drawings. The present invention is not limited to the following embodiments.

(The First Embodiment)

A spectral envelope parameter generation apparatus (Hereinafter, it is called "generation apparatus") as a speech processing apparatus of the first embodiment is explained by referring to FIGS. 1~22. The generation apparatus input speech data and outputs a spectral envelope parameter of each speech frame (extracted from the speech data).

The "spectral envelope" is spectral information which a spectral fine structure (occurred by periodicity of sound source) is excluded from a short temporal spectrum of speech, i.e., a spectral characteristic such as a vocal tract characteristic and a radiation characteristic. In the first embodiment, a logarithm spectral envelope is used as spectral envelope information. However, it is not limited to the logarithm spectral envelope. For example, such as an amplitude spectrum or a power spectrum, frequency region information representing spectral envelope may be used.

FIG. 1 is a block diagram of the generation apparatus according to the first embodiment. The generation apparatus includes a frame extraction unit 11, an information extraction unit 12, a parameter calculation unit 13, a basis generation unit 14, and a basis storage unit 15. The frame extraction unit 11 extracts speech data in each speech frame. The information extraction unit 12 (Hereinafter, it is called "envelope extraction unit") extracts a logarithm spectral envelope from each speech frame. The basis generation unit 14 generates local domain bases. The basis storage unit 15 stores the local domain bases generated by the basis generation unit 14. The parameter calculation unit 13 (Hereinafter, it is called "parameter calculation unit") calculates a spectral envelope parameter from the logarithm spectral envelope using the local domain bases stored in the basis storage unit 15.

Figure 2:
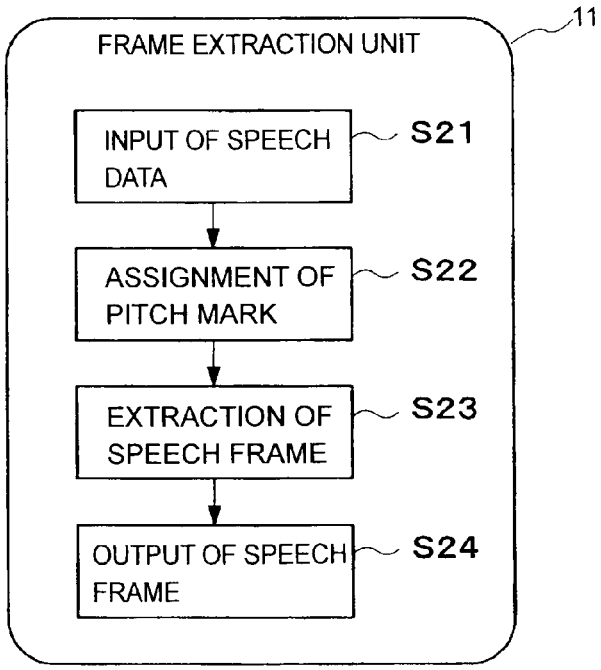
FIG. 2 is a flow chart of processing of a frame extraction unit in FIG. 1.

FIG. 2 is a flow chart of processing of the frame extraction unit 11. With regard to the frame extraction unit 11, speech data is input (S21), a pitch mark is assigned to the speech data (S22), a pitch-cycle waveform is extracted as a speech frame from the speech data according to the pitch mark (S23), and the speech frame is output (s24).

The "pitch mark" is a mark assigned in synchronization with a pitch period of speech data, and represents time at a center of one period of a speech waveform. The pitch mark is assigned by, for example, the method for extracting a peak within the speech waveform of one period.

The "pitch-cycle waveform" is a speech waveform corresponding to a pitch mark position, and a spectrum of the pitch-cycle waveform represents a spectral envelope of speech. The pitch-cycle waveform is extracted by multiplying Hanning window having double pitch-length with the speech waveform, centering around the pitch mark position.

The "speech frame" represents a speech waveform extracted from speech data in correspondence with a unit of spectral analysis. A pitch-cycle waveform is used as the speech frame.

Figure 3:
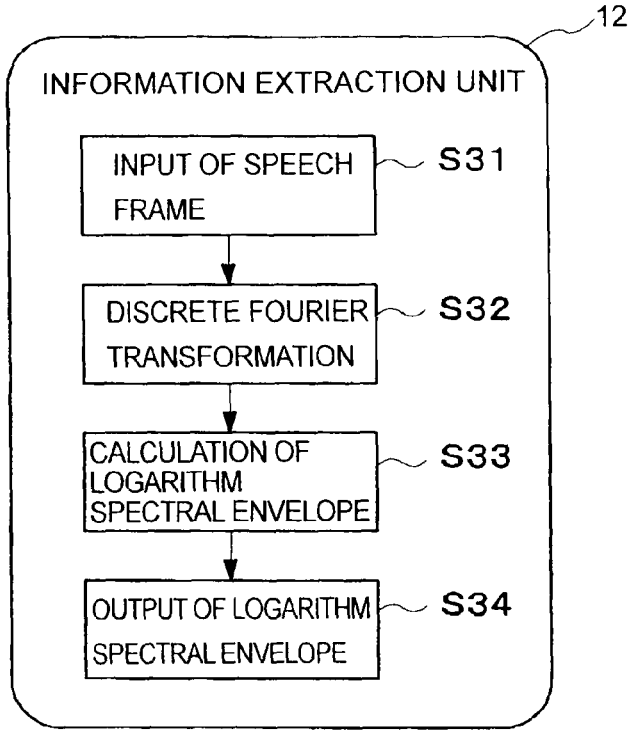
FIG. 3 is a flow chart of processing of an information extraction unit in FIG. 1.

The information extraction unit 12 extracts a logarithm spectral envelope from speech data obtained. FIG. 3 is a flow chart of processing of the information extraction unit 12. As shown in FIG. 3, with regard to the information extraction unit 12, a speech frame is input (S31), a Fourier transform is subjected to the speech frame and a spectrum is obtained (S32), a logarithm spectral envelope is obtained from the spectrum (S33), and the logarithm spectral envelope is output (S34).

The "logarithm spectral envelope" is spectral information of a logarithm spectral region represented by a predetermined number of dimension. By subjecting the Fourier transform to a pitch-cycle waveform, a logarithm power spectrum is calculated, and a logarithm spectral envelope is obtained.

The method for extracting a logarithm spectral envelope is not limited to the Fourier transform of pitch-cycle waveform by Hanning window having double pitch-length. Another spectral envelope extraction method such as the cepstrum method, the linear prediction method, and the STRAIGHT method, may be used.

The basis generation unit 14 generates a plurality of local domain bases.

The "local domain basis" is a basis of a subspace in a space formed by a plurality of logarithm spectral envelopes, which satisfies following three conditions.

Condition 1: Positive values exist within a spectral region of speech, i.e., a predetermined frequency band including a peak frequency (maximum value) along a frequency axis. Zero values exist outside the predetermined frequency band along the frequency axis. Briefly, values exist within some range along the frequency axis, and zero exists outside the range. Furthermore, this range includes a single maximum, i.e., a band of this range is limited along the frequency axis. In other words, this frequency band does not have a plurality of maximum, which is different from a periodical basis (basis used for cepstrum analysis).

Condition 2: The number of basis is smaller than the number of dimension of the logarithm spectral envelope. Each basis satisfies above-mentioned condition 1.

Condition 3: Two bases of which peak frequency positions are adjacent along the frequency axis partially overlap. As mentioned-above, each of bases has a peak frequency along the frequency axis. With regard to two bases having two peak frequencies adjacent, each frequency range of the two bases partially overlaps along the frequency axis.

The local domain basis satisfies three conditions 1, 2 and 3, and a coefficient corresponding to the local domain basis is calculated by minimizing a distortion (explained hereinafter). As a result, the coefficient is a parameter having three effects, i.e., "high quality", "effective", and "easy execution of processing corresponding to the band".

With regard to the first effect ("high quality"), a distortion between a linear combination of bases and a spectral envelope is minimized. Furthermore, as mentioned in the condition 3, an envelope having smooth transition can be reappeared because two adjacent bases overlap along the frequency axis. As a result, "high quality" can be realizes.

With regard to the second effect ("effective"), as mentioned in the condition 2, the number of bases is smaller than the number of dimension of the spectral envelope. Accordingly, the processing is more effective.

With regard to the third effect ("easy execution of processing corresponding to the band"), as mentioned in the condition 3, a coefficient corresponding to each local domain basis represents a spectrum of some frequency band. Accordingly, processing corresponding to the band can be easily executed.

Figure 4:
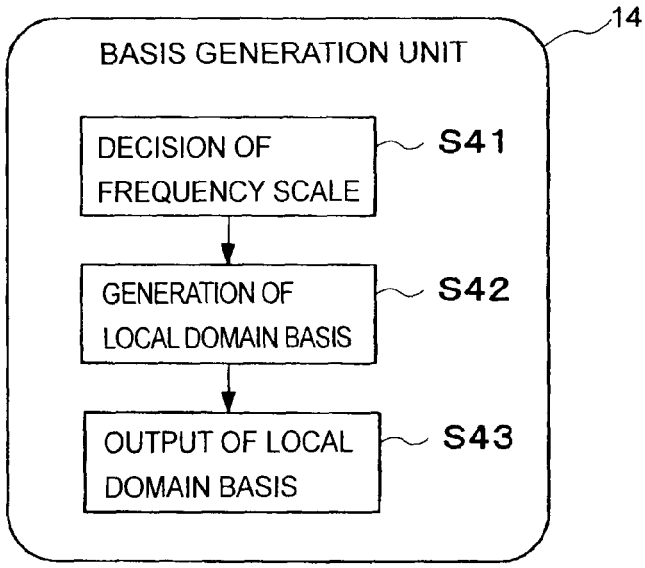
FIG. 4 is a flow chart of processing of a basis generation unit in FIG. 1.

FIG. 4 is a flow chart of processing of the basis generation unit 14. As shown in FIG. 4, with regard to the basis generation unit 14, a peak frequency (frequency scale) of each local domain basis along the frequency axis is determined (S41), a local domain basis is generated according to the frequency scale (S42), and the local domain basis is output and stored in the basis storage unit 15 (S43).

At S41, a frequency scale (a position of a peak frequency having predetermined number of dimension) is determined on the frequency axis.

At S42, a local domain basis is generated by Hanning window function having the same length as an interval of two adjacent peak frequencies along the frequency axis. By using the Hanning window function, the sum of bases is "1", and a flat spectrum can be represented by the bases.

The method for generating the local domain basis is not limited to the Hanning window function. Another unimodal window function, such as a Hamming window, a Blackman window, a triangle window, and a Gaussian window, may be used.

In case of a unimodal function, a spectrum between two adjacent peak frequencies monotonously increases/decreases, and a natural spectrum can be resynthesized. However, the method is not limited to the unimodal function, and may be SINC function having several extremal values.

In case of generating a basis from training data, the basis often has a plurality of extremal values. In the present embodiment, a set of local domain bases each having "zero" outside the predetermined frequency band on the frequency axis is generated. However, in case of resynthesizing a spectrum from the parameter, in order to smooth a spectrum between two adjacent peak frequencies, two bases corresponding to two adjacent peak frequencies partially overlap on the frequency axis. Accordingly, the local domain basis in not an orthogonal basis, and the parameter cannot be calculated by simple product operation. Furthermore, in order to effectively represent the spectrum, the number of local domain basis (the number of dimension of the parameter) is set to be smaller than the number of points of the logarithm spectral envelope.

At S41, in order to generate the local domain basis, a frequency scale is determined. The frequency scale is a peak position on the frequency axis, and set along the frequency axis according to the predetermined number of bases. With regard to frequency below "$\pi/2$", the frequency scale is set at an equal interval on a mel scale. With regard to frequency after "$\pi/2$", the frequency scale is set at an equal interval on a straight line scale.

The frequency scale may be set at an equal interval on non-linear frequency scale such as a mel scale or a bark scale. Furthermore, the frequency scale may be set at an equal interval on a linear frequency scale.

After the frequency scale is determined, at S42, as mentioned-above, the local domain basis is generated by Hanning window function. At S43, the local domain basis is stored in the basis storage unit 15.

Figure 5:
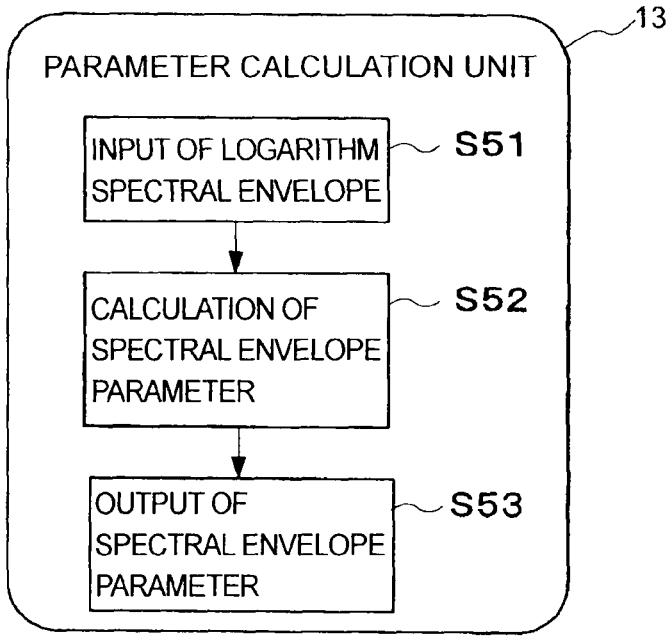
FIG. 5 is a flow chart of processing of a parameter calculation unit in FIG. 1.

As shown in FIG. 5, the parameter calculation unit 13 executes a logarithm spectral envelope input step (S51), a spectral envelope parameter calculation step (S52), and a spectral envelope parameter output step S53.

At S52, a coefficient corresponding to each local domain basis is calculated so that a distortion between a logarithm spectral envelope (input at S51) and a linear combination of the coefficient and the local domain basis (stored in the basis storage unit 15).

At S53, the coefficient corresponding to each local domain basis is output as a spectral envelope parameter. The distortion is a scale representing a difference between a spectrum resynthesized from the spectral envelope parameter and the logarithm spectral envelope. In case of using a squared error as the distortion, the spectral envelope parameter is calculated by the least squares method.

The distortion is not limited to the squared error, and may be a weighted error or an error scale that a regularization term (to smooth the spectral envelope parameter) is added to the squared error.

Furthermore, non-negative least squares method having constraint to set non-negative spectral envelope parameter may be used. Based on a shape of the local domain basis, a valley of spectrum can be represented as the sum of a fitting along negative direction and a fitting along positive direction. In order for the spectral envelope parameter to represent outline of the logarithm spectral envelope, the fitting along negative direction (by negative coefficient) is not desired.

In order to solve this problem, the least squares method having non-negative constraint can be used. In this way, at S52, the coefficient is calculated to minimize the distortion, and the spectral envelope parameter is calculated. At S53, the spectral envelope parameter is output. In this case (S53), the spectral envelope parameter may be quantized to reduce information quantity.

Figure 6:
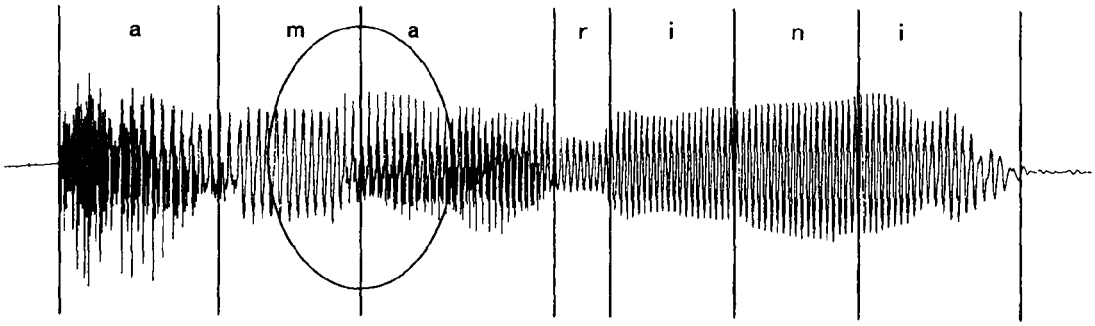
FIG. 6 is an exemplary speech data to explain processing of the spectral envelope parameter generation apparatus.

Hereinafter, as to speech data shown in FIG. 6, detail processing is explained using an exemplary calculation of spectral envelope parameter. FIG. 6 shows speech data of utterance "amarini"(Japanese).

Figure 7:
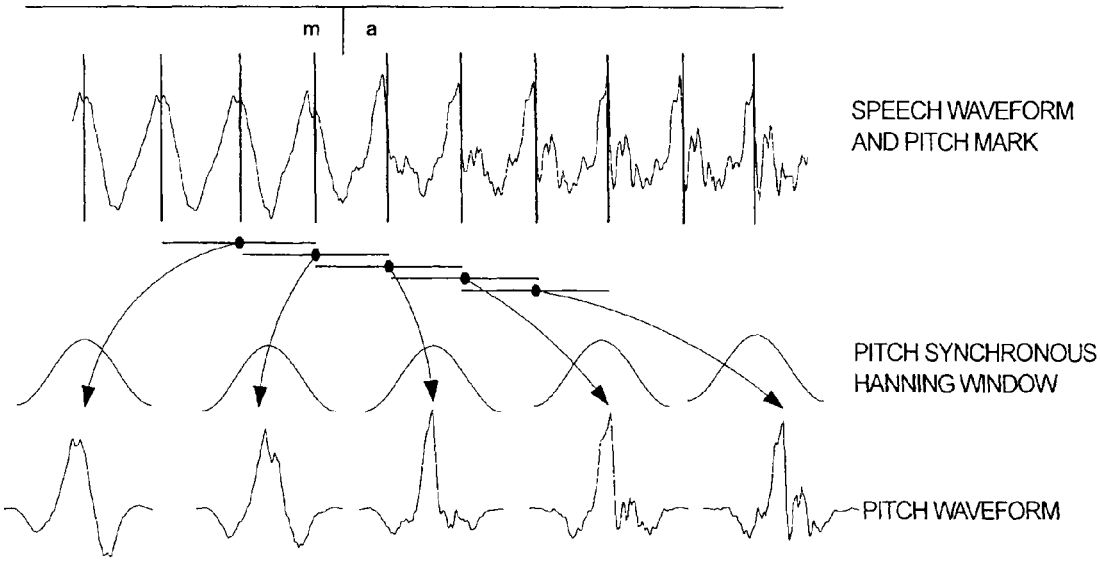
FIG. 7 is a schematic diagram to explain processing of the frame extraction unit.

At S21 in FIG. 2, speech data is input to the frame extraction unit 11. At S22, a pitch mark is assigned to the speech data. FIG. 7 shows a speech waveform which a waveform "ma" is enlarged. As shown in FIG. 7, at S22, the pitch mark is added to a position corresponding to each period of the waveform.

At S23 in FIG. 2, a pitch-cycle waveform corresponding to each pitch mark position is extracted. Briefly, by multiplying a Hanning window (having double pitch length) centering the pitch mark on the window, the pitch-cycle waveform is extracted as a speech frame.

With regard to the information extraction unit 12, each speech frame is subjected to the Fourier transform, and a logarithm spectral envelope is obtained. Concretely, by applying the discrete Fourier transform, a logarithm power spectrum is calculated, and the logarithm spectral envelope is obtained.

$$S(k) = \log\left|\sum_{l=0}^{L-1} x(l)\exp\left(-j\frac{2\pi}{L}lk\right)\right|^2 \tag{1}$$

In above equation (1), "x(l)" represents a speech frame, "S(k)" represents a logarithm spectrum, "L" represents the number of points of the discrete Fourier transform, and "j" represents an imaginary number unit.

As to a spectral envelope parameter, the logarithm spectral envelope of L-dimension is modeled by linear combination of local domain basis and coefficients as follows.

$$X(k) = \sum_{i=0}^{N-1} c_i\phi_i(k),\ (0 \le k \le L-1) \tag{2}$$

In above equation (2), "N" represents the number of local domain basis, i.e., the number of dimension of spectral envelope parameter, "X(k)" represents a logarithm spectral envelope of L-dimension (generated from the spectral envelope parameter), "$\phi_i(k)$" represents a local domain basis vector of L-dimension, and "$c_i(0<=i<=N-1)$"represents a spectral envelope parameter.

Figure 8:
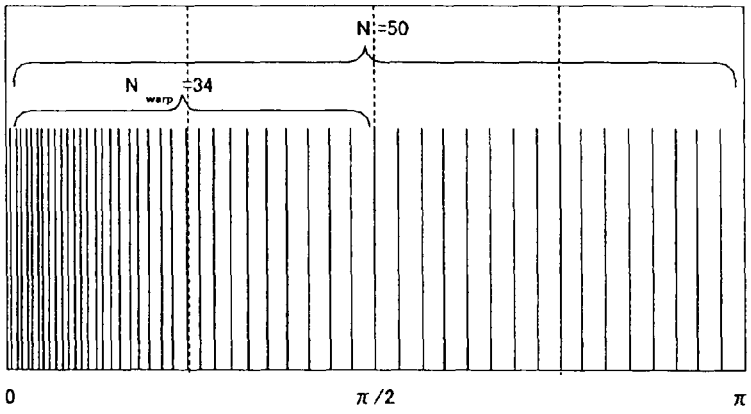
FIG. 8 is an exemplary frequency scale.

The local domain generation unit 14 generates a local domain basis $\phi$. At S41 in FIG. 4, first, a frequency scale is determined. FIG. 8 shows the frequency scale. In this case, "N=50", and the frequency scale is sampled at an equal interval point on the mel scale in a frequency range "0~π/2" as follows.

$$\Omega(i) = \omega + 2\tan^{-1}\frac{\alpha\sin\omega}{1-\alpha\cos\omega},\ \varpi = \frac{i}{N_{warp}}\pi,\ i < N_{warp} \tag{3}$$

Furthermore, the frequency scale is sampled at an equal interval point on the straight line scale in a frequency range "π/2~π" as follows.

$$\Omega(i) = \frac{i-N_{warp}}{N-N_{warp}}\pi + \frac{\pi}{2},\ N_{warp} < i < N \tag{4}$$

In above equations (3) and (4), "Ω(i)" represents i-th peak frequency. "$N_{warp}$"is calculated so that a period changes smoothly from a band of mel scale to a band having an equal period. In case of "N=50" and "α=0.35", it is determined that "$N_{warp}$=34" for "22.05 Hz" signal (α: frequency warping parameter). In this case, as shown in FIG. 8, a frequency resolution of a low band rises in a range "0~π/2" (period is short). Then, the frequency resolution gradually extends from the low band to a high band in the range "0~π/2"(period gradually lengthens). Last, the frequency resolution is equal in a range "π/2~π"(period is equal). "L" is the number of points of the discrete Fourier transform (represented by the equation (1)), which is used as a fixed value longer than a length of speech frame. In order to use FFT, "L" is a power of "2", for example "1024". In this case, a logarithm spectral envelope represented by 1024 points is effectively represented by a spectral envelope parameter of 50 points.

At S42, according to the frequency scale generated at S41, a local domain basis is generated using Hanning window. A basis vector $\phi i(k)$ (1<=i<=N−1) is represented as follows.

$$\Phi i(k) = \begin{cases} 0.5 - 0.5\cos\left(\frac{k-\Omega(i-1)}{\Omega(i)-\Omega(i-1)}\pi\right) & \ldots\ \Omega(i-1) \le k \le \Omega(i) \\ 0.5 - 0.5\cos\left(\frac{k-\Omega(i)}{\Omega(i+1)-\Omega(i)}\pi\right) & \ldots\ \Omega(i-1) \le k \le \Omega(i) \\ 0 & \ldots\ \text{otherwise} \end{cases} \tag{5}$$

A basis vector $\phi i(k)$ (i=0) is represented as follows.

$$\Phi i(k) = \begin{cases} 0.5 - 0.5\cos\left(\frac{k-\Omega(i)}{\Omega(i+1)-\Omega(i)}\pi\right) & \ldots\ \Omega(i) \le k \le \Omega(i+1) \\ 0 & \ldots\ \text{otherwise} \end{cases} \tag{6}$$

Figure 9:
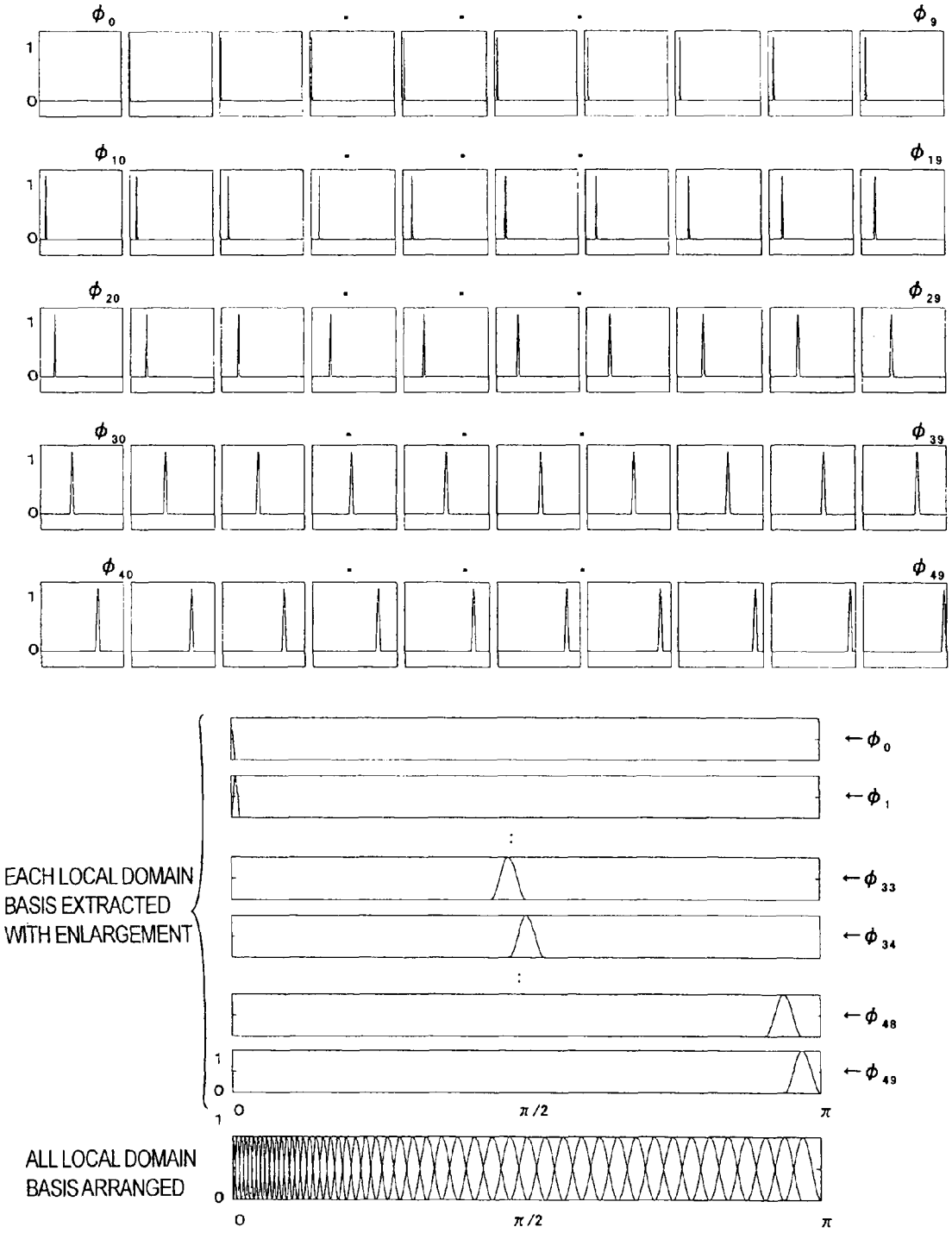
FIG. 9 is an exemplary local domain bases.

In above equations (5) and (6), assume that Ω(0)=0 and Ω(N)=π. FIG. 9 shows the local domain basis calculated by the equations (5) and (6). In FIG. 9, the upper part shows all bases plotted, the middle part shows several bases enlarged, and the lower part shows all local domain bases arranged. In the middle part, several bases ($\phi_0$, $\phi_1$, . . . ) are selectively shown. As shown in FIG. 9, each local domain basis is generated by Hanning window function having the same length as a frequency scale width (an interval between two adjacent peak frequencies).

With regard to each local domain basis, a peak frequency is $\Omega(i)$, a bandwidth is represented as $\Omega(i-1)\sim\Omega(i+1)$, and values outside the bandwidth along a frequency axis are zero. The sum of local domain bases is "1" because the local domain bases are generated by Hanning window. Accordingly, a flat spectrum can be represented by the local domain bases.

In this way, at S42, the local domain basis is generated according to the frequency scale (created at S41), and stored in the basis storage unit 15.

With regard to the parameter calculation unit 13, a spectral envelope parameter is calculated using the logarithm spectral envelope (obtained by the information extraction unit 12) and the local domain basis (stored in the basis storage unit 15).

As a measure of a distortion between the logarithm spectral envelope S(k) and a linear combination X(k) of the basis with coefficient, a squared error is used. In case of using the least squares method, an error "e" is calculated as follows.

$$e=\|S-X\|^2=(S-X)^T(S-X)=(S-\Phi c)^T(S-\Phi c) \tag{7}$$

In the equation (7), S and X are a vector-representation of S(k) and X(k) respectively. "$\Phi=(\phi_1, \phi_2, \ldots, \phi_N)$" is a matrix which basis vectors are arranged.

By solving simultaneous equations (8) to determine an extremal value, the spectral envelope parameter is obtained. The simultaneous equations (8) can be solved by the Gaussian elimination or the Cholesky decomposition.

$$\begin{aligned}&\frac{\partial e}{\partial c}(S-\Phi c)^T(S-\Phi c)=\Phi^T\Phi c-\Phi^T S=0\\&c=(\Phi^T\Phi)^{-1}\Phi^T S\end{aligned} \tag{8}$$

In this way, the spectral envelope parameter is calculated. At S53 in FIG. 5, the spectral envelope parameter c is output.

Figure 10:
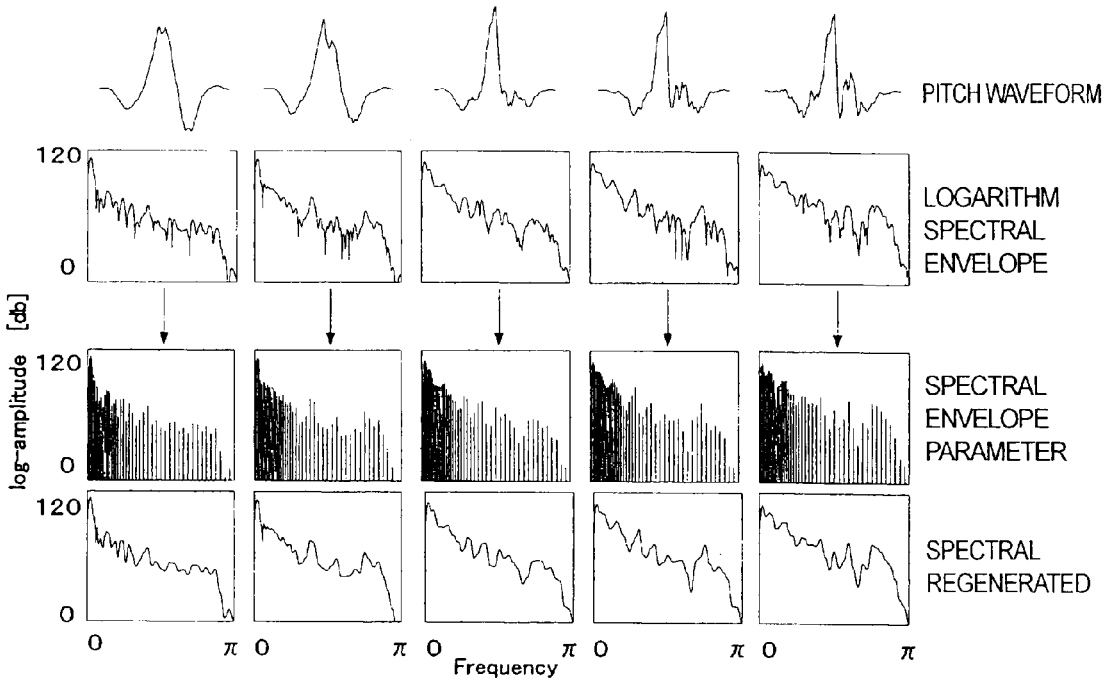
FIG. 10 is an exemplary generation of a spectral envelope parameter.

FIG. 10 shows an exemplary spectral parameter obtained from each pitch-cycle waveform in FIG. 7. From upper position in FIG. 10, a pitch-cycle waveform, a logarithm spectral envelope (calculated by the equation (1)), a spectral envelope parameter (each dimensional value is plotted at peak frequency position), and a spectral envelope regenerated by the equation (2), are shown.

As shown in FIG. 10, the spectral envelope parameter represents an outline of the logarithm spectral envelope. The spectral envelope (regenerated) is similar to the logarithm spectral envelope of analysis source. Furthermore, without influence of valley of spectrum appeared from a middle band to a high band, the spectral envelope (regenerated) shapes smoothly. Briefly, the parameter satisfying "high quality", "effective"and "easy processing corresponding to the band", i.e., suitable for speech synthesis, is obtained.

At S52 in FIG. 5, the squared error is minimized without constraint for the spectral envelope parameter. However, the squared error may be minimized with constraint for non-negative coefficient.

In case of optimizing a coefficient using the non-orthogonal basis, a valley of a logarithm spectrum can be represented as the sum of a negative coefficient and a positive coefficient. In this case, the coefficient does not represent an outline of the logarithm spectrum, and it is not desired that a spectral envelope parameter becomes a negative value.

Furthermore, a spectrum which the logarithm spectrum is a negative value is smaller than "1" in a linear amplitude region, and becomes a sine wave which the amplitude is near "0" in a temporal region. Accordingly, in case that a logarithm spectrum is smaller than "0", the spectrum can be set to "0".

In order for a coefficient to be a parameter representing an outline of the spectrum, the coefficient is calculated using a non-negative least squares method. The non-negative least squares method is disclosed in C. L. Lawson, R. J. Hanson, "Solving Least Squares Problems", SIAM classics in applied mathematics, 1995 (first published by 1974), and a suitable coefficient can be calculated under a constraint of non-negative.

In this case, a constraint "c=>0" is added to the equation (7), and the error "e" calculated by following equation (9) is minimized.

$$e=\|S-X\|^2=(s-X)^T(S-X)=(S-c)^T(S-\Phi c),(c\geqq 0) \tag{9}$$

With regard to the non-negative least squares method, the solution is searched using an index sets P and Z. A solution corresponding to an index included in the index set Z is "0", and a value corresponding to an index included in the set P is a value except for "0". When the value is non-negative, the value is set to be positive or "0", and the index corresponding to the value is moved to the index set Z. At completion timing, the solution is represented as "c".

Figure 11:
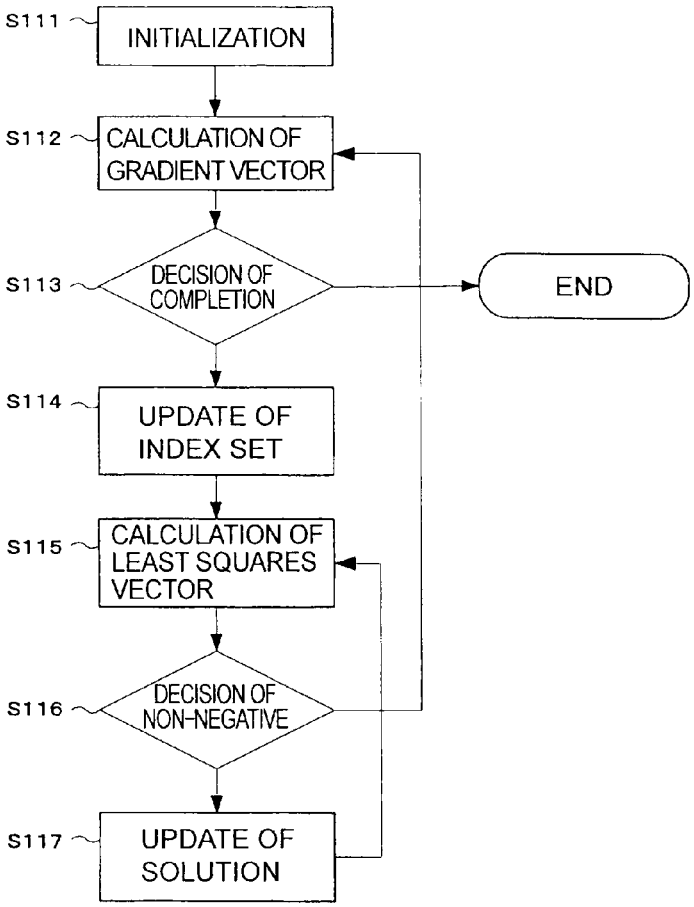
FIG. 11 is a flow chart of processing of the parameter calculation unit in case of using a non-negative least squares method.

FIG. 11 shows processing of S52 in FIG. 5 in case of using the non-negative least squares method. First, S111, assume that "P={ }, Z=(0, . . . , N−1), c=0". Next, s112, a gradient vector "w" is calculated as follows.

$$w=\Phi^T(S-\Phi c) \tag{10}$$

At S113, in case of the set Z being null or "w(i)<0"for index i in the set Z, processing is completed. Next, at S114, an index i having the maximum w(i) is searched from the set Z, and the index i is moved from the set Z to the set P. At S115, as to an index in the set P, the solution is calculated by the least squares method. Briefly, a matrix $\Phi_p$ of L×N is defined as follows.

$$\text{Column } i \text{ of } \Phi_p=\begin{cases}\text{column } i \text{ of } \Phi & \text{if } i\in P\\ 0 \text{ if } i\in Z\end{cases} \tag{11}$$

An squared error using $\Phi_p$ is calculated as follows.

$$\|S-\Phi_P c\|^2 \tag{12}$$

N-dimensional vector y to minimize the squared error is calculated. In this calculation, a value "$y_i$ (i∈P)" is only determined. Accordingly, assume that "$y_i$=0 (i∈Z)".

At S116, in case of "$y_i$>0 (i∈P)", processing is returned to S112 as "c=y". In another case, the processing is forwarded to S117. At S117, an index j is determined by following equation (13).

$$\begin{aligned}&\frac{c_j}{c_j-y_j}=\min_{y_i\leq 0, i\in P}\left\{\frac{c_i}{c_i-y_i}\right\}\\&\alpha=c_j/(c_j-y_j),\ c=c+\alpha(y-c)\end{aligned} \tag{13}$$

All index "i∈P ($c_i$=0)" is moved to the set Z, and processing is returned to S115. Briefly, as a result of minimization of the equation (9), an index having negative solution is moved to the set Z, and processing is returned to a calculation step of least squares vector.

By using above algorithm, the least squares solution of the equation (9) is determined under a condition that "$c_i$=>0 (i∈P), $c_i$=0 (i∈Z)". As a result, a non-negative spectral envelope parameter "c" is optimally calculated. Furthermore, in order for the spectral envelope parameter to easily be non-negative, a coefficient of negative value for the spectral envelope parameter calculated by the least squares method (using the equation (8)) may be set to "0". In this case, the non-negative spectral parameter can be determined, and a spectral envelope parameter suitably representing an outline of the spectral envelope can be searched.

Figure 12:
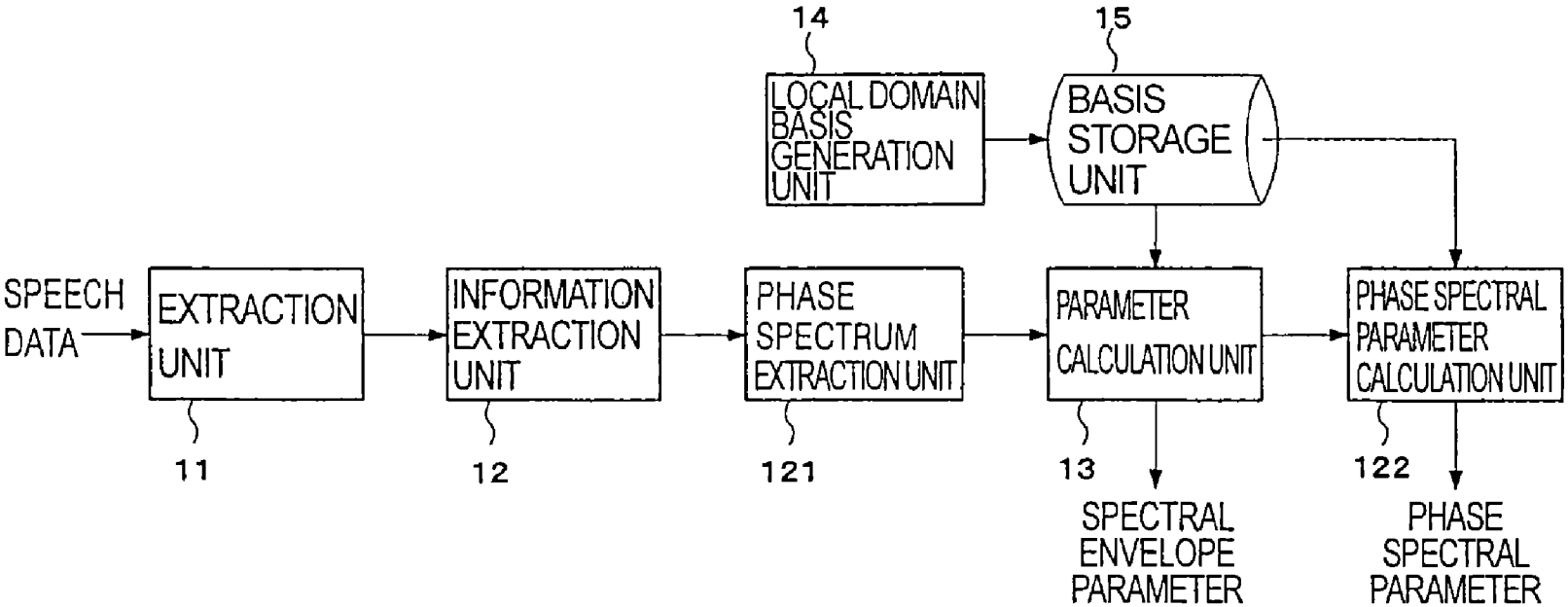
FIG. 12 is a block diagram of the spectral envelope parameter generation apparatus having a phase spectral parameter calculation unit.

In the same way as the spectral envelope parameter, phase information may be a parameter. In this case, as shown in FIG. 12, a phase spectrum extraction unit 121 and a phase spectral parameter calculation unit 122 are added to the generation apparatus.

With regard to the phase spectrum extraction unit 121, spectral information (obtained at S32 in the information extraction unit 12) is input, and phase information unwrapped is output.

Figure 13:
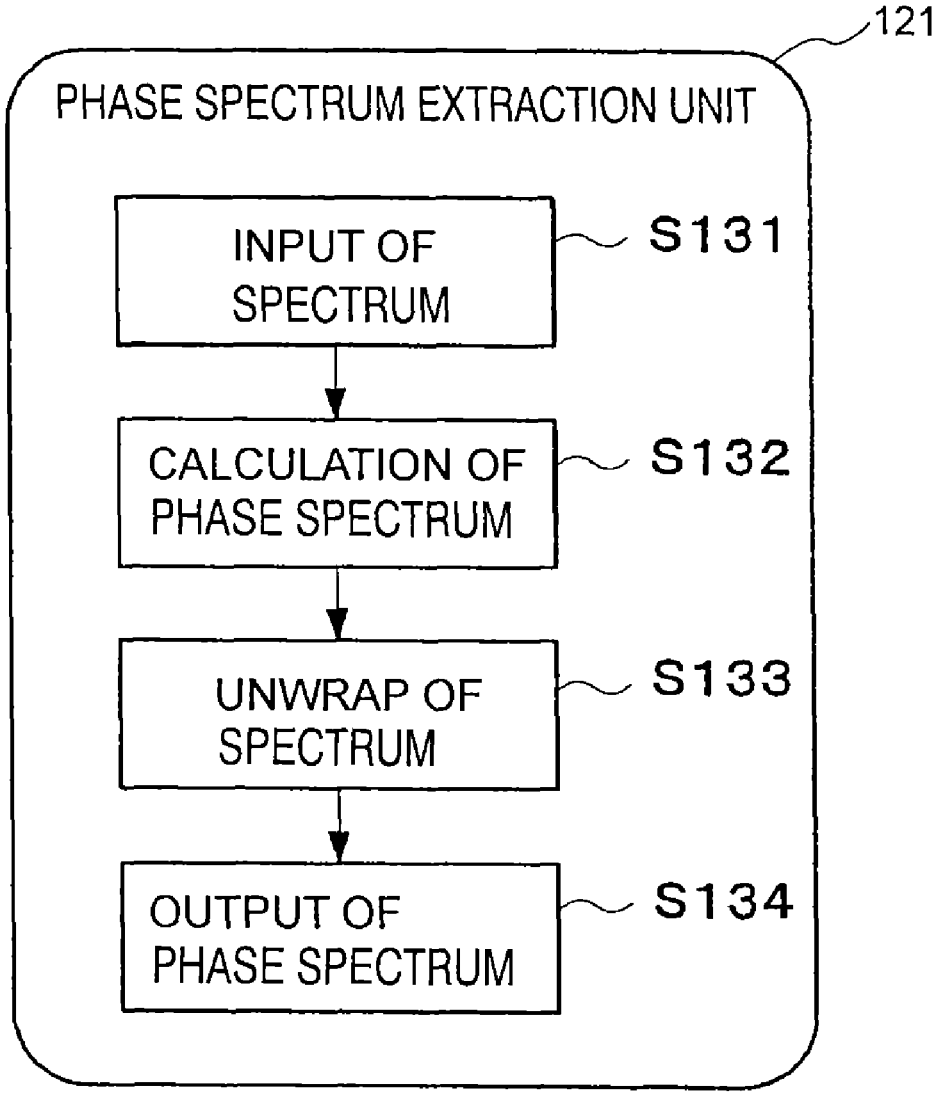
FIG. 13 is a flow chart of processing of a phase spectrum extraction unit in FIG. 12.
Figure 14:
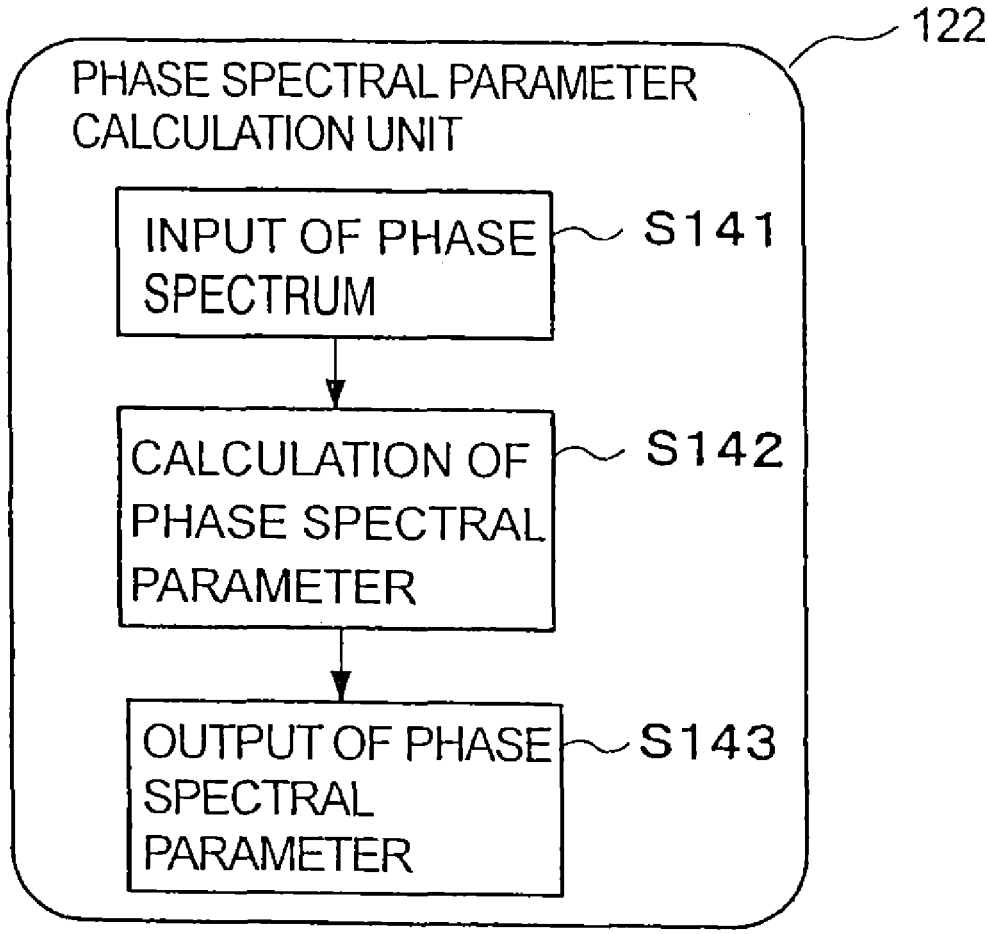
FIG. 14 is a flow chart of processing of phase spectral parameter calculation unit in FIG. 12.

As shown in FIG. 13, processing of the phase spectrum extraction unit 121 includes a step S131 to input a spectrum (by subjecting the discrete Fourier transform to a speech frame), a step S132 to calculate a phase spectrum from spectral information, a step S133 to unwrap the phase, and a step S134 to output the phase spectrum obtained.

At S132, a phase spectrum is calculated as follows.

$$P(k) = \arg\left(\sum_{l=0}^{L-1} x(l)\exp\left(-j\frac{2\pi}{L}lk\right)\right) \tag{14}$$

Actually, a phase spectrum is generated by calculating an arctangent of a ratio of an imaginary part to a real part of Fourier transform.

At S132, a principal value of phase is determined, but the principal value has discontinuity. Accordingly, at S133, the phase is unwrapped to remove discontinuity. With regard to phase-unwrap, in case that a phase is shifted above π from an adjacent phase, times of integral number of 2π is added to or subtracted from the phase.

Next, with regard to the phase spectral parameter calculation unit 122, a phase spectral parameter is calculated from the phase spectrum obtained by the phase spectrum extraction unit 121.

In the same way as the equation (2), the phase spectrum is represented as a linear combination of basis (stored in the basis storage unit 15) with a phase spectral parameter.

$$Y(k) = \sum_{i=0}^{N-1} d_i\phi_i(k),\ (0 \le k \le L-1) \tag{15}$$

In the equation (15), "N" is dimensional number of the phase spectral parameter, "Y(k)" is L-dimensional phase spectrum generated from the phase spectral parameter, "$\phi_i$(k)" is L-dimensional local domain basis vector which is generated in the same way as a basis of the spectral envelope parameter, and "$d_i$(0<=i<=N−1)" is the phase spectral parameter.

As shown in F*ig*.14, the phase spectral parameter calculation unit 122 includes a step S141 to input a phase spectrum, a step S142 to calculate a phase spectral parameter, and a step S143 to output the phase spectral parameter.

At S142, in the same way as calculation of the spectral envelope parameter by the least squares method (using the equation (8)), a phase spectral parameter is calculated. Assume that the phase spectral parameter is "d" and a distortion of the phase spectrum is a squared error "e".

$$e=\|P-\Phi d\|^2=(P-\Phi d)^T(P-\Phi d) \tag{16}$$

In the equation (16), "P" is a vector-notation of P(k), and Φ is a matrix which local domain bases are arranged. By solving simultaneous equations (shown in (17)) with Gaussian elimination or Cholesky decomposition, the phase spectral parameter is obtained as an extremal value.

$$\frac{\partial e}{\partial d}(P-\Phi d)^T(P-\Phi d) = \Phi^T\Phi d - \Phi^T P = 0 \tag{17}$$
$$d = (\Phi^T\Phi)^{-1}\Phi^T P$$

Figure 15:
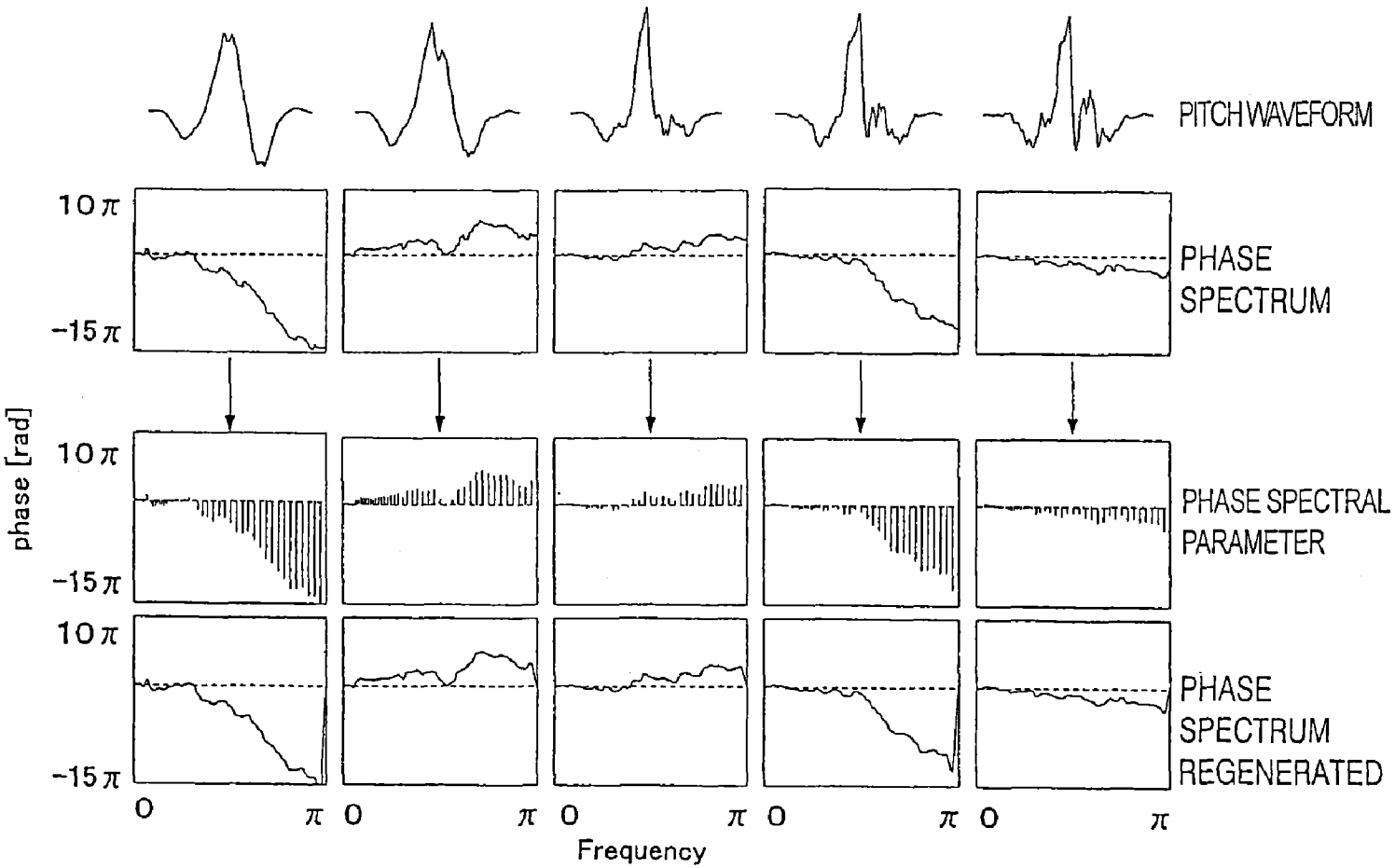
FIG. 15 is an exemplary generation of a phase spectral parameter.

FIG. 15 shows an exemplary phase spectral parameter from a pitch-cycle waveform shown in FIG. 7. In FIG. 15, the upper part shows a pitch-cycle waveform, and the second upper part shows a phase spectrum unwrapped. A phase spectral parameter (shown in the third upper part) appears an outward form the phase spectrum. Furthermore, as shown in the bottom part, a phase spectrum regenerated from the phase spectral parameter by the equation (15) is similar to the phase spectrum of analysis source, i.e., high quality parameter can be obtained.

The above-mentioned generation apparatus uses a local domain basis generated by Hanning window. However, from a logarithm spectral envelope prepared as training data, the local domain basis may be generated using a sparse coding method disclosed in Bruno A. Olshausen and David J. Field, "Emergence of simple-cell receptive field properties by learning a sparse code for natural images" Nature, vol. 381, Jun. 13, 1996.

The sparse coding method is used in the image processing region, and an image is represented as a linear combination of basis. By adding a regularization term which represents a sparse coefficient to a squared error term, an evaluation function is generated. By generating a basis to minimize the evaluation function, a local domain basis is automatically obtained from image data as training data. By applying the sparse coding method to a logarithm spectrum of speech, the local domain basis to be stored in the basis storage unit 15 is generated. Accordingly, as to speech data, optimal basis to minimize the evaluation function of the sparse coding method can be obtained.

Figure 16:
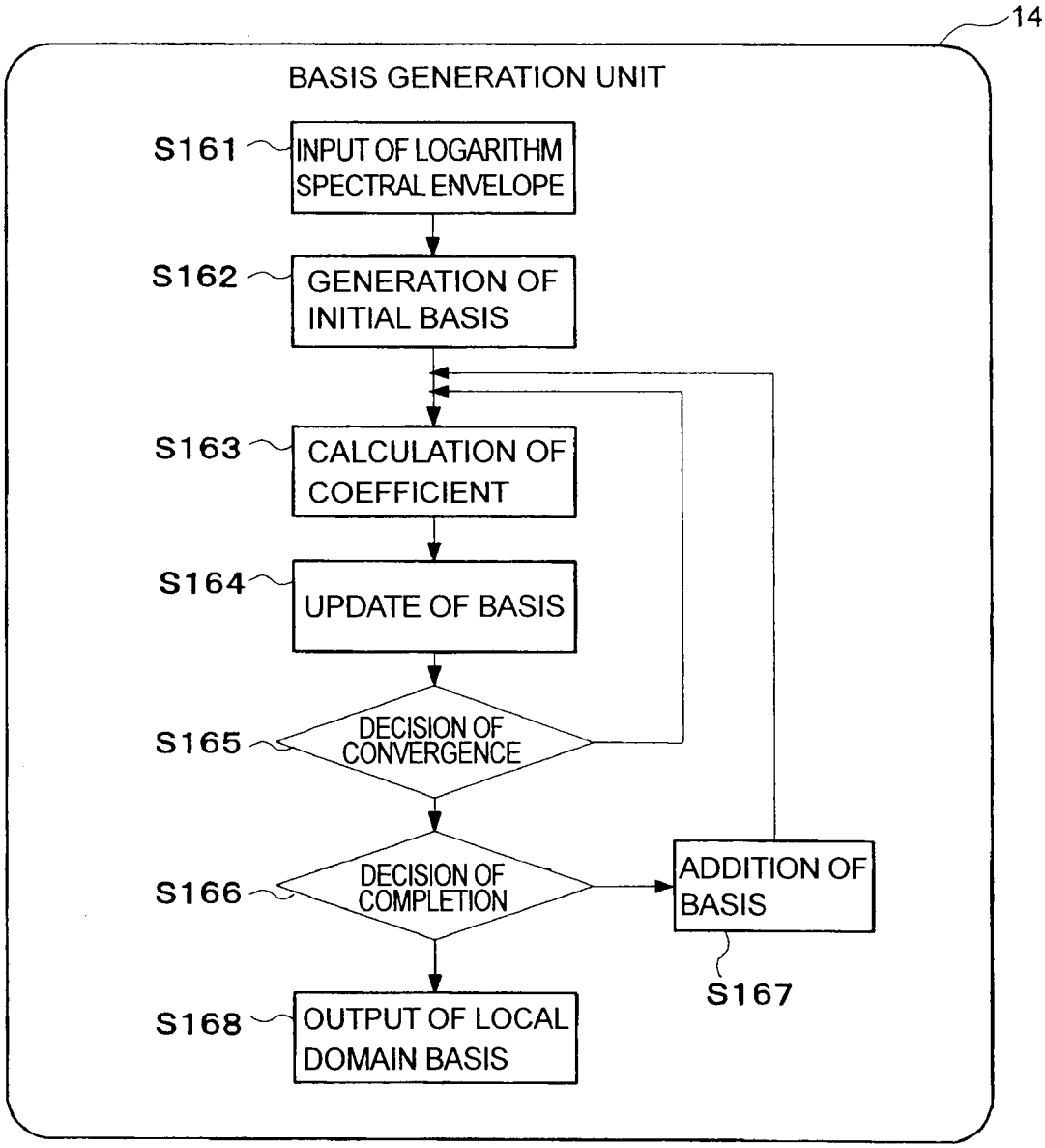
FIG. 16 is a flow chart of processing of the basis generation unit in case of generating a local domain basis by a sparse coding method.

FIG. 16 is a flow chart of processing of the basis generation unit 14 in case of generating a basis by the sparse coding method.

The basis generation unit 14 executes a step S161 to input a logarithm spectral envelope from speech data as training data, a step S162 to generate an initial basis, a step S163 to calculate a coefficient for the basis, a step S164 to update the basis based on the coefficient, a step S165 to decide whether update of the basis is converged, a step S166 to decide whether a number of basis is a predetermined number, a step S167 to generate the initial basis by adding a new basis if the number of basis is not below the predetermined number, and a step S168 to output a local domain basis if the number of basis is the predetermined number.

At S161, a logarithm spectral envelope calculated from each pitch-cycle waveform of speech data (training data) is input. Extraction of the logarithm spectral envelope from speech data is executed in the same way as the frame extraction unit 11 and the information extraction unit 12.

At S162, assume that the number N of basis is "1" and "$\phi_0(k)=1(0<=k<L)$". An initial basis is generated.

At S163, a coefficient corresponding to each logarithm spectral envelope is calculated from the present basis and each logarithm spectral envelope of training data. As an evaluation function of sparse coding, following equation is used.

$$E = (X^r - \Phi c^r)^T (X^r - \Phi c^r) + \lambda \sum_{i=0}^{N-1} S(c_i^r) + \mu \sum_{i=0}^{N-1} \phi_{ik}^2 (k - v_i)^2 \quad (18)$$

In the equation (18), "E" represents an evaluation function, "r" represents a number of training data, "X" represents a logarithm spectral envelope, "Φ" represents a matrix in which basis vectors are arranged, "c" represents a coefficient, and "S(c)" represents a function representing sparseness of coefficient. "S'(c)" has a smaller value when "c" is nearer "0"(In this case, $S(c)=\log(1+c^2)$). Furthermore, "γ" represents a center of gravity of basis φ, and "λ and μ" represents a weight coefficient for each regularization term.

In the equation (18), the first term is an error term (squared error) as the sum of distortion between the logarithm spectral envelope and a linear combination of local domain basis with coefficient. The second term is a regularization term representing sparseness of coefficient, of which value is smaller when the coefficient is nearer "0". The third term is a regularization term representing concentration degree at a position to a center of basis, of which value is larger when a value at the position distant from the center of the basis is larger. In this case, the third term may be omitted.

At S163, a coefficient, "$c^{r'}$" to minimize the equation (18) is calculated for all training data $X^r$. The equation (18) is a non-linear equation, and the coefficient can be calculated using a conjugate gradient method.

At S164, the basis is updated by the gradient method. A gradient of the basis φ is calculated from an expected value of gradient (obtained by differentiating the equation (18) with φ) as follows.

$$\Delta\phi_i = \eta\left\langle c_i[X - \Phi c] - 2\mu \sum_k (k - v_i)^2 \phi_{ik} \right\rangle \quad (19)$$

By replacing "Φ" with "Φ+ΔΦ", the basis is updated. "η"is a fine quantity used for training by the gradient method.

Next, S165, convergence of update of basis by the gradient method is decided. If a difference of value between the evaluation function and a previous evaluation function is larger than a threshold, processing is returned to S163. If the difference is smaller than the threshold, repeat operation by the gradient method is decided to be converged, and processing is forwarded to S166.

At S166, it is decided whether a number of basis reaches a predetermined value. If the number of basis is smaller than the predetermined value, a new basis is added, "N" is replaced with "N+1", and processing is returned to S163. As the new basis,"$\phi_{N-1}(k)=1(0<=k<L)$" is set as an initial value. By above-processing, the basis is automatically generated from training data.

Figure 17:
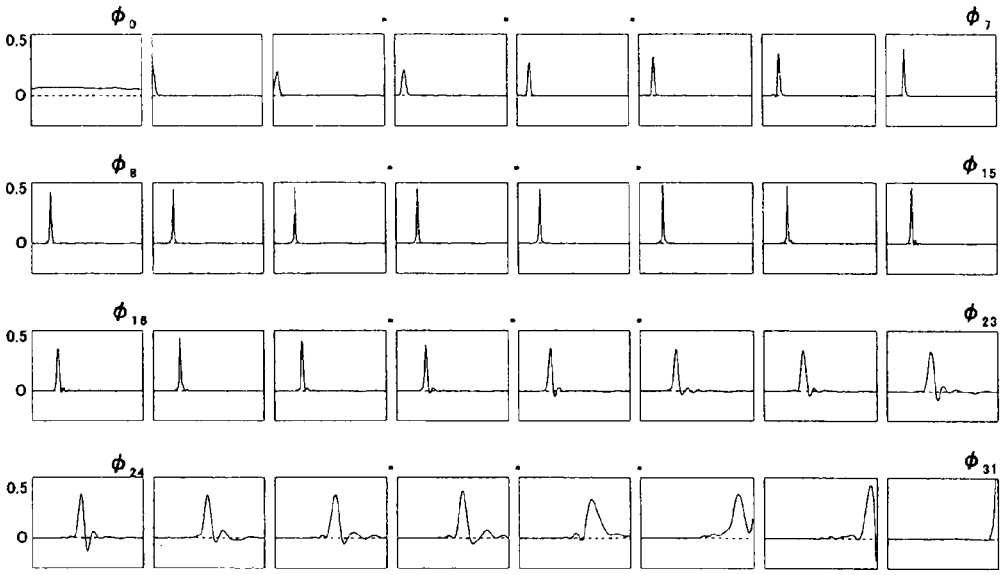
FIG. 17 is an exemplary local domain bases generated by the sparse coding method.

At S168, a set of basis (finally obtained) are output. In this case, by multiplying a window function, a value corresponding to a frequency outside a frequency band (principle value) of the basis is set to "0". FIG. 17 shows exemplary bases generated by above-processing.

In FIG. 17, the number "N" of bases is "32", a logarithm spectrum converted to mel scale is given as "X", and bases trained by above-processing are shown. One basis ($\phi_0$) existing all frequency band is included. However, as shown in FIG. 17, a set of local domain basis along a frequency axis is automatically generated. In case of calculating a spectral envelope parameter using the basis (trained by sparse coding), in the same way as the basis generation unit 14, the parameter calculation unit 13 calculates the spectral envelope parameter using the evaluation function by the equation (18). By this processing, the spectral envelope parameter is generated using the local domain basis automatically generated from training data. Accordingly, high quality-spectral parameter can be obtained.

Figure 18:
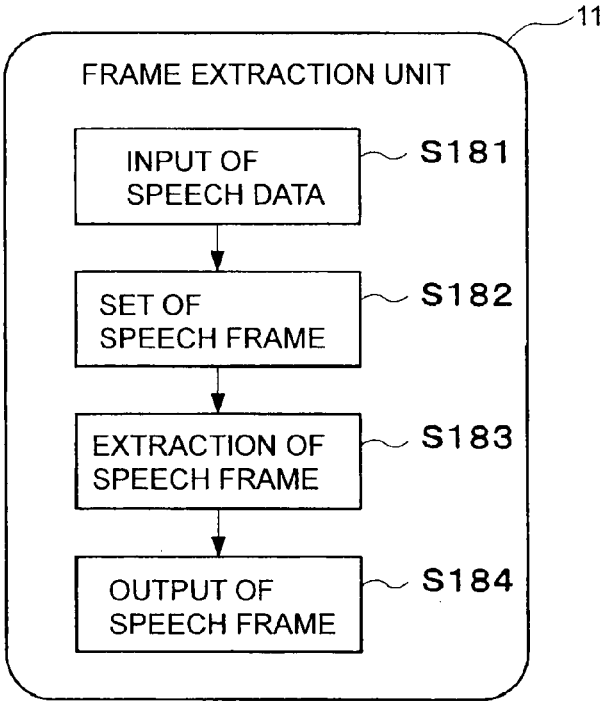
FIG. 18 is a flow chart of processing of the frame extraction unit in case of analyzing a fixed frame rate and a fixed window length.

In the above-mentioned generation apparatus, a spectral envelope parameter is calculated based on pitch synchronization analysis. However, the spectral envelope parameter may be calculated from a speech parameter having a fixed frame period and a fixed frame length. As shown in FIG. 18, the frame extraction unit 11 includes a step S181 to input speech data, a step S182 to set a time of a center of frame based on a fixed frame rate, a step S183 to extract a speech frame by a window function having a fixed frame length, and a step S184 to output the speech frame. The information extraction unit 12 inputs the speech frame and outputs a logarithm spectral envelope.

Figure 19:
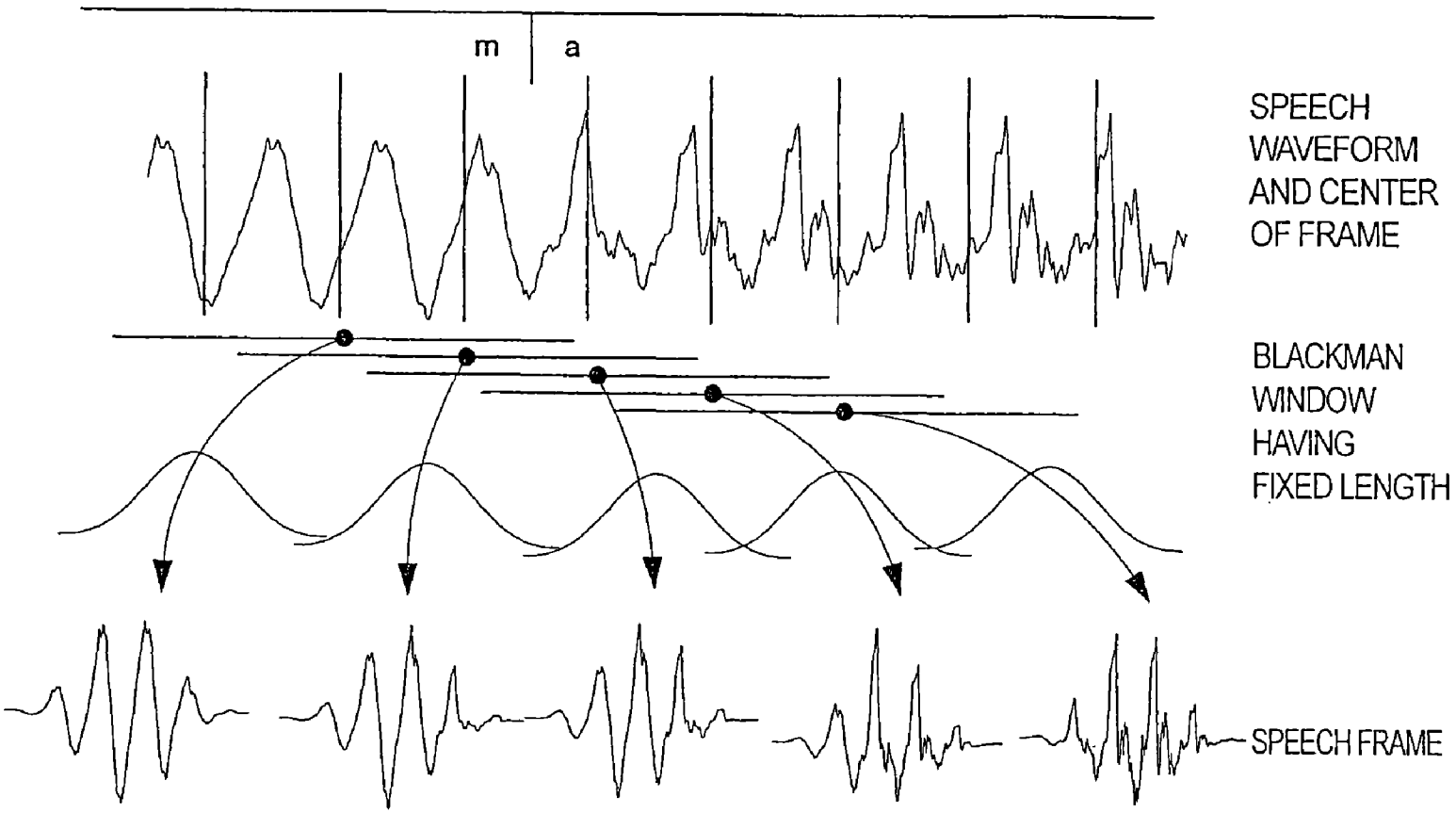
FIG. 19 is a schematic diagram to explain processing of the frame extraction unit in case of analyzing a fixed frame rate and a fixed window length.

As to speech data in FIG. 7, an exemplary analysis using window length 23.2 ms (512 points), 10 ms shift and Blackman window, is shown in FIG. 19. At S181, a center of analysis window is determined at a fixed period "10 ms". Different from FIG. 7, the center of analysis window does not synchronize with pitch. In FIG. 19, the upper part shows a speech waveform having a center of frame, and the lower part shows a speech frame extracted by multiplying the Blackman window.

Figure 20:
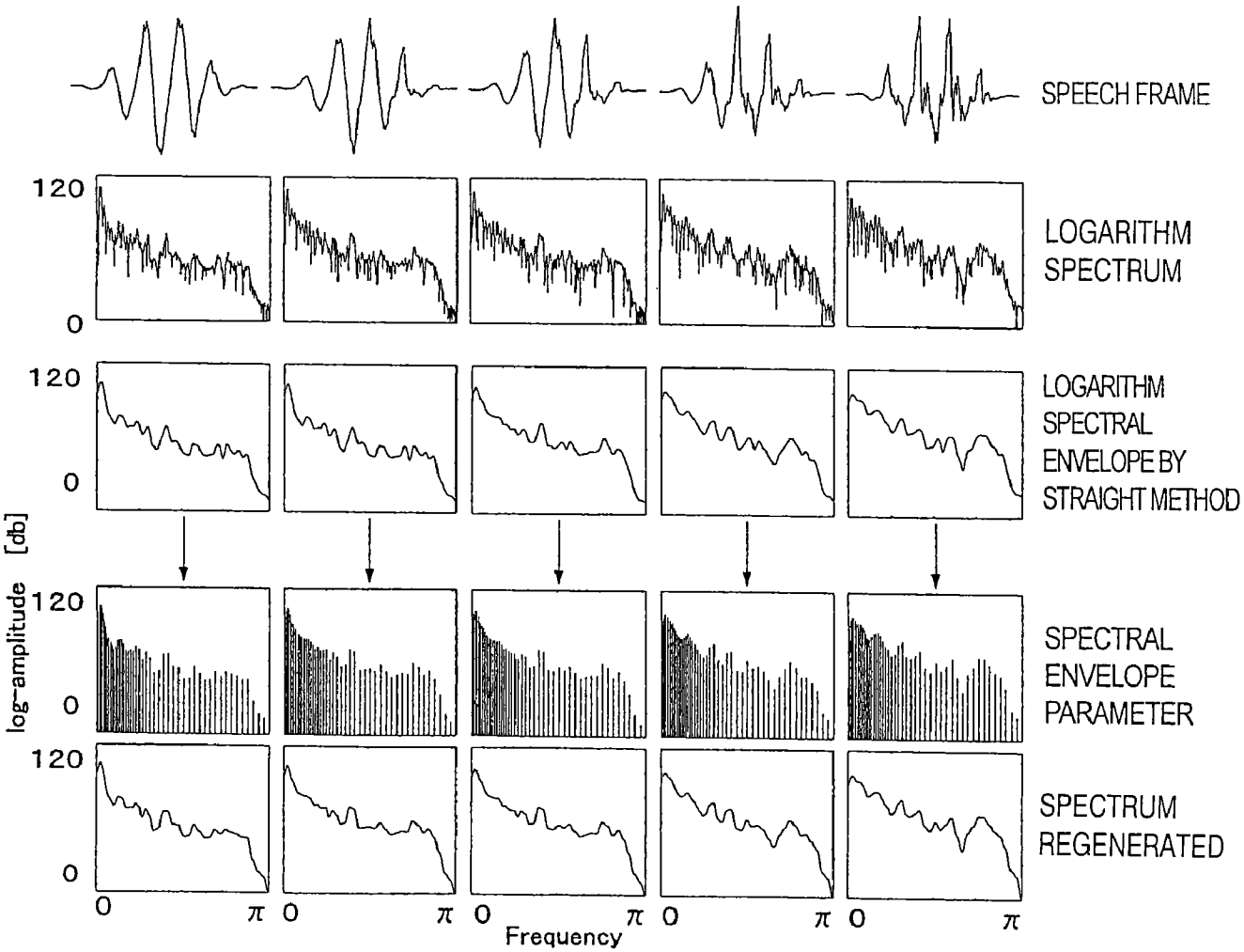
FIG. 20 is an exemplary generation of the spectral envelope parameter in case of analyzing a fixed frame rate and a fixed window length.

FIG. 20 shows exemplary spectral analysis and spectral parameter generation in the same way as FIG. 10. In case of a fixed frame, each speech frame includes a plurality of pitches, and the spectrum has not a smooth envelope but a fine structure (occurred by Harmonics). The second upper part in FIG. 20 shows a logarithm spectrum obtained by Fourier transform. In case that a spectral envelope parameter as a coefficient of local domain basis is extracted from the spectrum having a fine structure (fine structure part), the spectral envelope parameter directly fits onto the fine structure at a low band (having high resolution) of a frequency domain. Briefly, a spectral envelope regenerated from the spectral envelope parameter does not shape smoothly.

Accordingly, in case of fixed frame period and length, after a logarithm spectral envelope is extracted from a speech frame at S33 in FIG. 3, the parameter calculation unit 13 calculates a spectral envelope parameter by fitting a coefficient of local domain basis onto the logarithm spectral envelope. The logarithm spectral envelope can be extracted by a linear prediction method, a mel cepstrum-unbiased estimation method, or a STRAIGHT method. The third part in FIG. 20 shows the logarithm spectral envelope obtained by the STRAIGHT method. In the STRAIGHT method, a spectral envelope is obtained by eliminating a change part along a temporal direction with a complementary time window and by smoothing along a frequency axis with a smoothing function that keeps the original spectral value at each harmonic frequency.

As to the spectral envelope parameter obtained as mentioned-above, the spectral parameter calculation unit 13 calculates a spectral envelope parameter (coefficient) used for linear combination with the local domain basis. Processing of the spectral envelope parameter 13 can be executed in the same way as the analysis of pitch synchronization.

In FIG. 20, the second lower part and the lower part show the spectral envelope parameter obtained and a spectrum regenerated using the spectral envelope parameter respectively. Apparently, the spectrum similar to an original (input) logarithm spectrum is regenerated.

In above-explanation, after a spectral envelope is obtained, a spectral envelope parameter is calculated. However, the sum of a distortion between the logarithm spectrum and a spectrum regenerated from the spectral envelope parameter, and a regularization term to smooth coefficient, may be used as the evaluation function. In this case, the spectral envelope parameter is directly calculated from the logarithm spectrum.

As mentioned-above, in case of fixed frame period and length, the spectral envelope parameter used for linear combination with the local domain basis can be generated.

At S52 in FIG. 5, a spectral envelope parameter is directly output. However, by quantizing the spectral envelope parameter based on the frequency band, information quantity of the spectral envelope parameter may be reduced.

Figure 21:
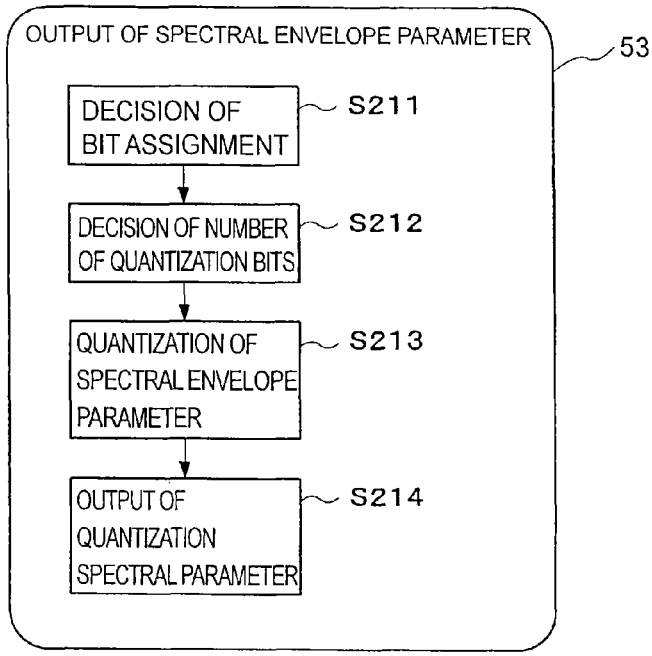
FIG. 21 is a flow chart of processing of S53 in FIG. 5 in case of quantizing the spectral envelope parameter.

In this case, as shown in FIG. 21, the step S53 includes a step S211 to determine a number of quantized bits for each dimension of spectral envelope parameter, a step S212 to determine a number of quantization bits, a step S213 to actually quantize the spectral envelope parameter, and a step S214 to output the spectral envelope parameter quantized.

At S211, in the same way as assignment of adaptive information for subband-coding, information is optimally assigned by variable bit rate of each dimension. Assume that an average information quantity is "B", an average of coefficient of each dimension is "$\mu_i$" and a standard deviation is "$\sigma_i$", an optimal number of bits "$b_i$" is calculated as follows.

$$b_i = B + \frac{1}{2}\log_2\left\{\sigma_i^2 \Big/ \left(\prod_{j=0}^{N-1} \sigma_i^2\right)^{\frac{1}{N}}\right\} \tag{20}$$

At S212, a number of quantization bits is determined based on the number of bits "$b_i$" and the standard deviation "$\sigma_i$". In case of uniform-quantization, the number of quantization bits is determined from a maximum "$c_i^{max}$" and a minimum "$c_i^{min}$" of each dimension as follows.

$$\Delta c_i = (c_i^{max} - c_i^{min})/2^{b_i} \tag{21}$$

Furthermore, an optimum quantization to minimize a distortion of quantization may be executed.

At S213, each coefficient of spectral envelope parameter is quantized using the number of bits "$b_i$" and the number of quantization bits "$c_i$". Assume that "$q_i$" is a quantized result of "$c_i$" and "Q" is a function to determine a bit array. The quantization is operated as follows.

$$q_i = Q(c_i - \mu_i/\Delta c_i) \tag{22}$$

At S214, a quantized result "$q_i$" of each spectral envelope parameter, "$\mu_i$" and "$\Delta c_i$", are output.

In above-explanation, quantization is executed at the optimal bit rate. However, quantization may be executed at a fixed bit rate. Furthermore, in above-explanation, "$\sigma_i$" is a standard deviation of spectral envelope parameter. However, a standard deviation may be calculated from a parameter converted to linear amplitude "sqrt(exp($c_i$))". Furthermore, a phase spectral parameter may be quantized in the same way. By searching a principal value within "−π~π" phase, the phase spectral parameter is quantized.

Figure 22:
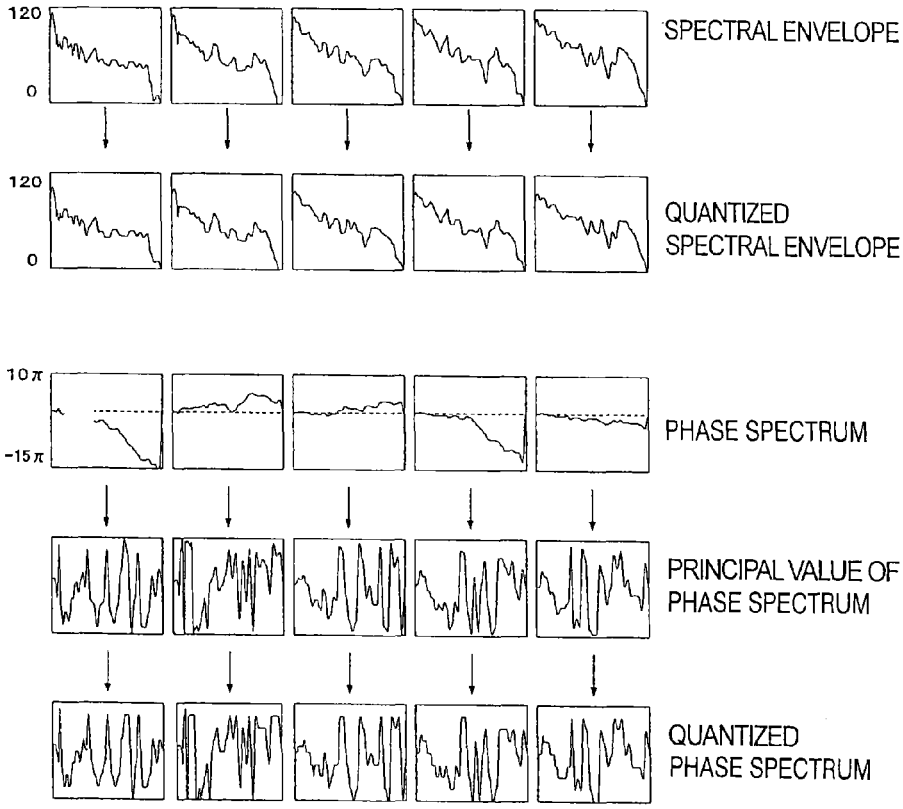
FIG. 22 is an exemplary quantized spectral envelope and a quantized phase spectrum.

Assume that the number of quantization bits for spectral envelope parameter is 4.75 bits (averaged) and the number of quantization bits for phase spectral parameter is 3.25 bits (averaged). FIG. 22 shows a spectral envelope with a quantized spectral envelope, a phase spectrum and a principal value of phase spectrum with a quantized phase spectrum. In FIG. 22, the quantized spectral envelope and the quantized phase spectrum are regenerated from the spectral envelope and the principal value of phase spectrum respectively. Each quantized spectral result includes a few quantization errors, but is similar to the original spectrum (before quantization). In this way, by quantizing the spectral parameter, the spectrum can be more effectively represented.

As mentioned-above, in the generation apparatus of the first embodiment, speech data is input, and a parameter is calculated based on a distortion between a logarithm spectral envelope and a linear combination of a local domain basis with the parameter. Accordingly, a spectral envelope parameter having three aspects ("high quality", "effective", "easy execution of processing corresponding to band") can be obtained.

(The Second Embodiment)

A speech synthesis apparatus of the second embodiment is explained by referring to FIGS. 23~26.

Figure 23:
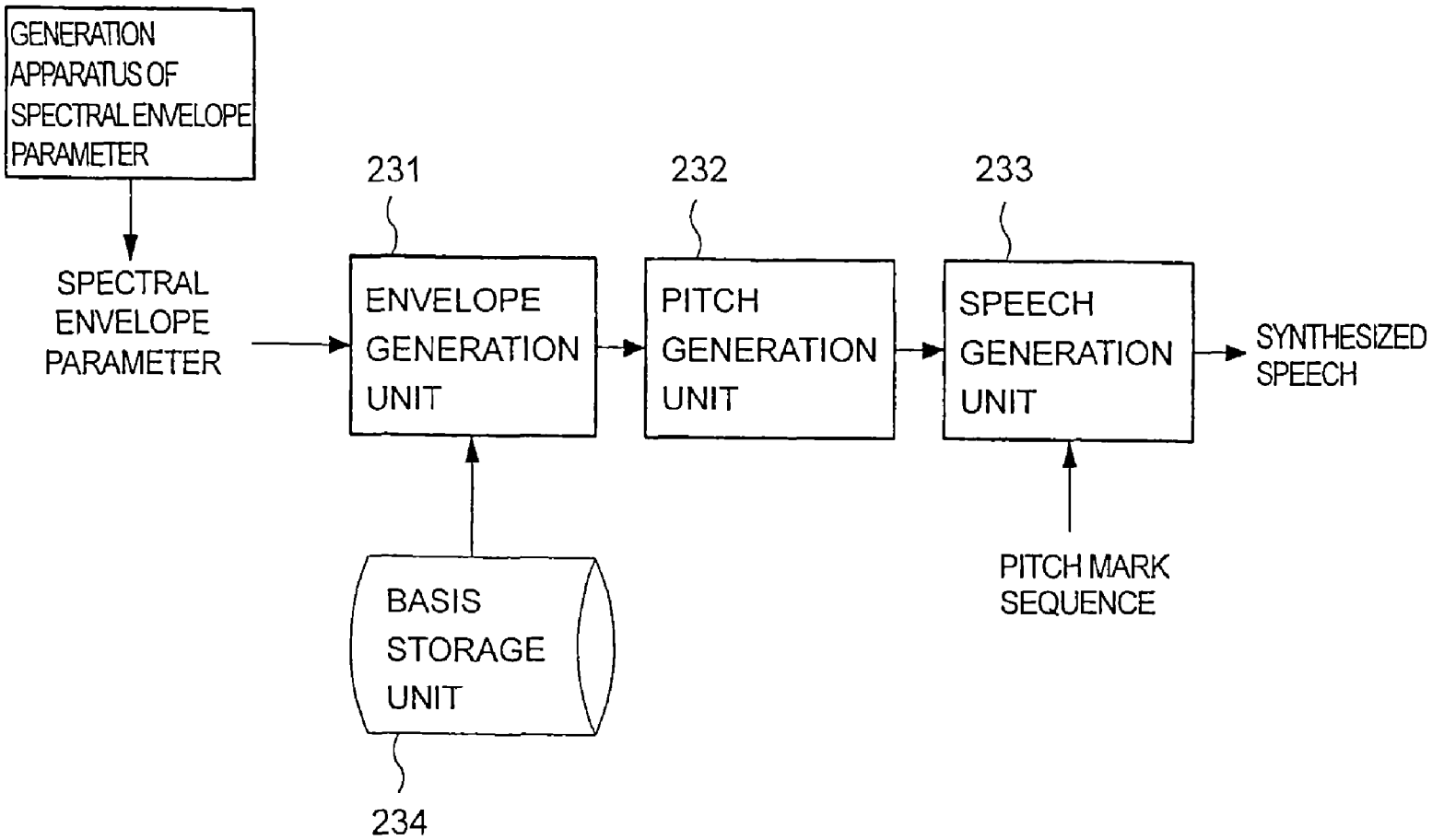
FIG. 23 is a block diagram of a speech synthesis apparatus according to a second embodiment.

FIG. 23 is a block diagram of the speech synthesis apparatus of the second embodiment. The speech synthesis apparatus includes an envelope generation unit 231, a pitch generation unit 232, and a speech generation unit 233. A pitch mark sequence and a spectral envelope corresponding to each pitch mark time (from the generation apparatus of the first embodiment) are input, and a synthesized speech is generated.

The envelope generation unit 231 generates a spectral envelope from the spectral envelope parameter inputted. Briefly, the spectral envelope is generated by linearly combining a local domain basis (stored in a basis storage unit 234) with the spectral envelope parameter. In case of inputting a phase spectral parameter, a phase spectrum is also generated in the same way as the spectral envelope.

Figure 24:
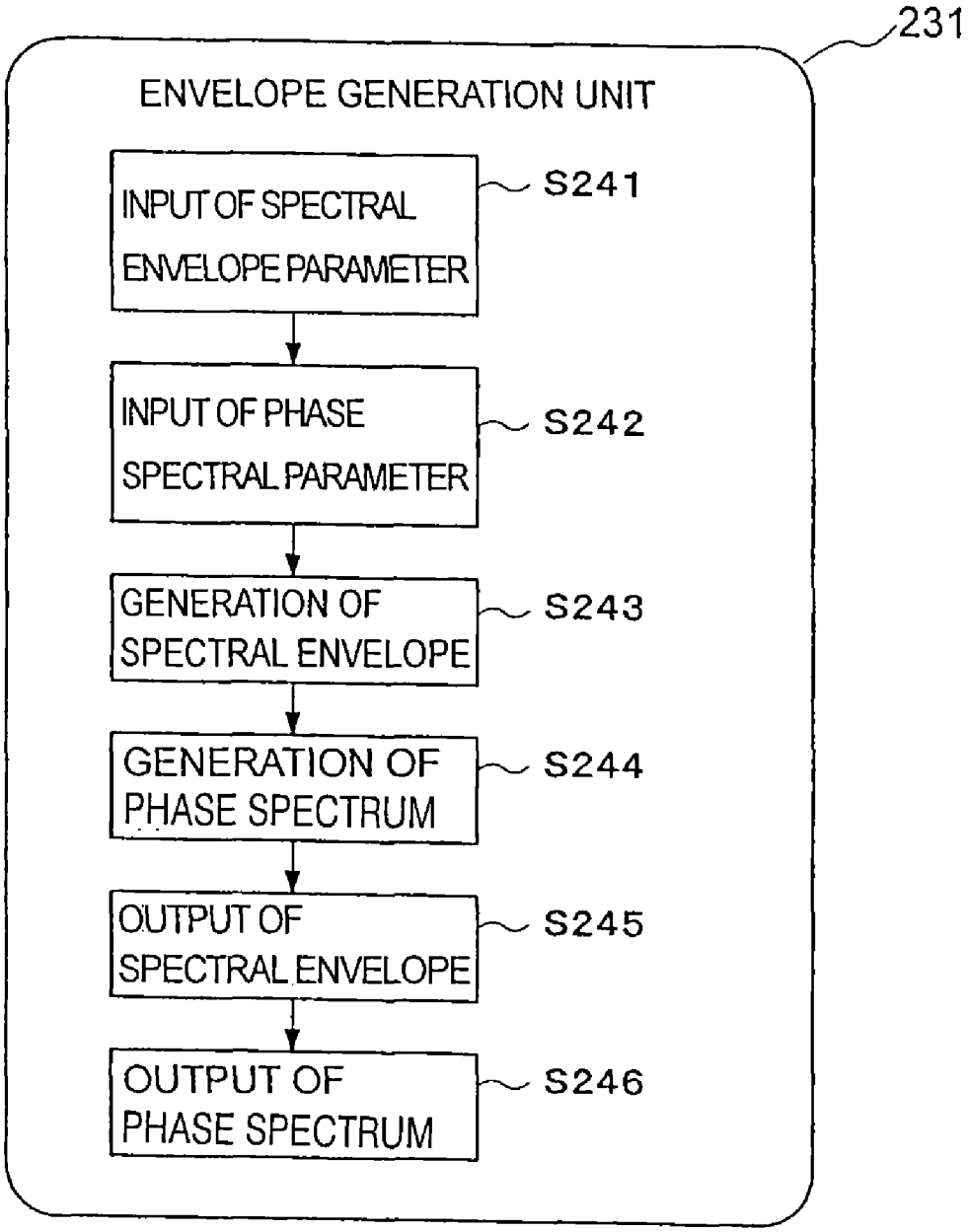
FIG. 24 is a flow chart of processing of an envelope generation unit in FIG. 23.

As shown in FIG. 24, processing of the envelope generation unit 231, which functions as an acquisition unit, includes a step S241 to input a spectral envelope parameter, a step S242 to input a phase spectral parameter, a step S243 to generate a spectral envelope, a step S244 to generate a phase spectrum, a step S245 to output the spectral envelope, and a step s246 to output the phase spectrum.

At S243, a logarithm spectrum X(k) is calculated by the equation (2). At S244, a phase spectrum Y(k) is calculated by the equation (15).

Figure 25:
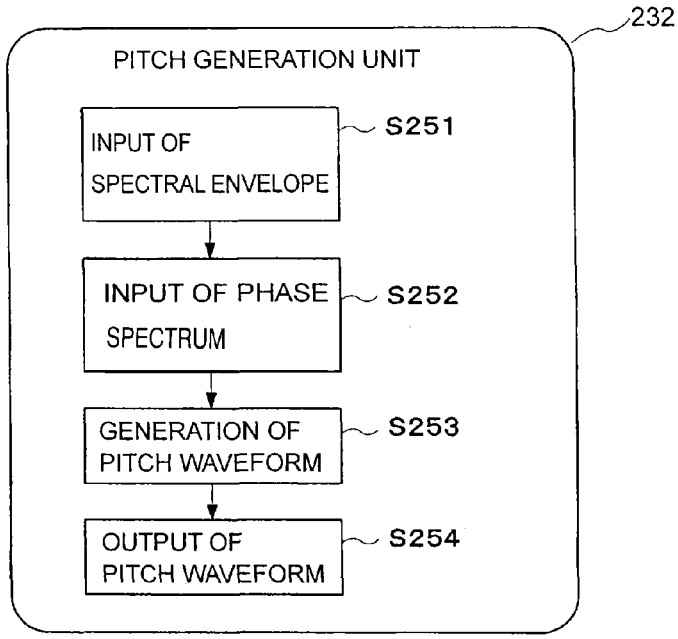
FIG. 25 is a flow chart of processing of a pitch generation unit in FIG. 23.

As shown in FIG. 25, processing of the pitch generation unit 232 includes a step S251 to input a spectral envelope, a step S252 to input a phase spectrum, a step S253 to generate a pitch-cycle waveform, and a step S254 to output the pitch-cycle waveform.

At S253, a pitch-cycle waveform is generated by discrete inverse-Fourier transform as follows.

$$x(k) = \frac{1}{N}\sum_{l=0}^{L-1} \sqrt{\exp(X(l))}\,\exp\left(-j\left(\frac{2\pi}{L}lk - Y(l)\right)\right) \tag{23}$$

A logarithm spectral envelope is converted to amplitude spectrum and subjected to inverse-FFT from the phase spectrum and the amplitude spectrum. By multiplying a short window with a start point and an end point of a frequency band, a pitch-cycle waveform is generated. Last, the speech generation unit 233 overlaps and adds the pitch-cycle waveforms according to the pitch mark sequence (inputted), and generates a synthesized speech.

Figure 26:
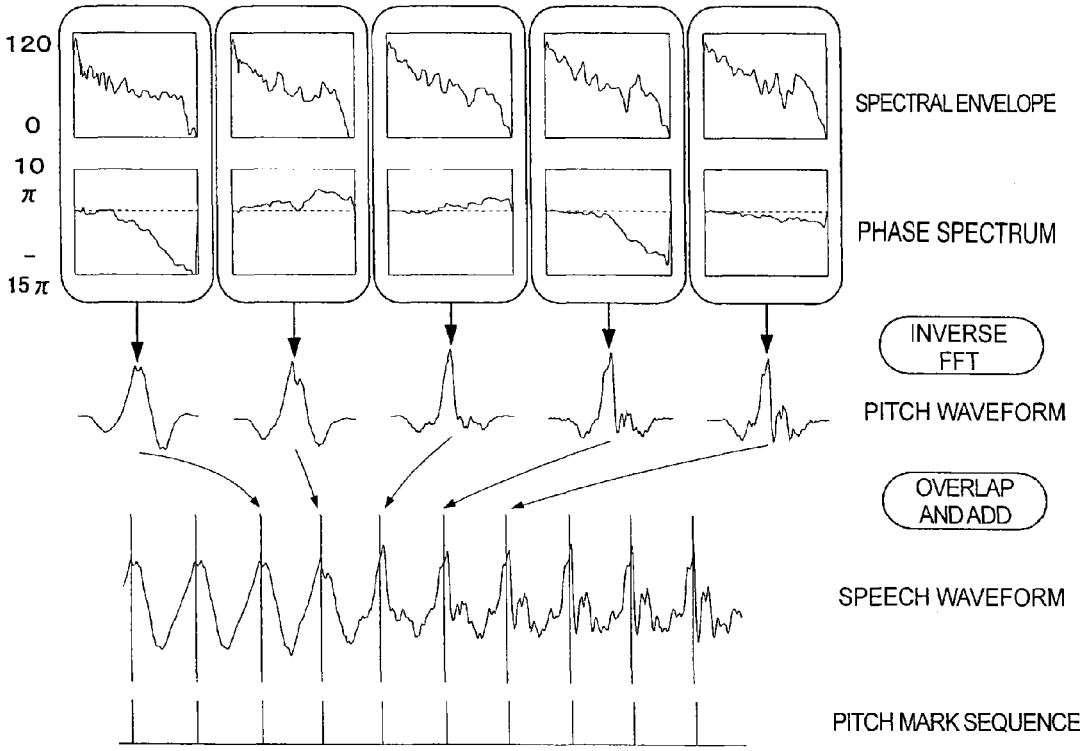
FIG. 26 is an exemplary processing of the speech synthesis apparatus.

FIG. 26 shows an exemplary processing of analysis and synthesis for speech waveform in FIG. 7. By using a spectral envelope and a phase spectrum regenerated from the spectral parameter (coefficients), a pitch-cycle waveform is generated by inverse-FFT. Then, by overlapping and adding the pitch-cycle waveforms centering time corresponding to each waveform of the pitch mark sequence, a speech waveform is generated.

As shown in FIG. 26, the speech waveform similar to a pitch-cycle waveform (original speech waveform in FIG. 7) is obtained. Briefly, the spectral envelope parameter and the phase parameter (obtained by the generation apparatus of the first embodiment) are high quality parameter, and a synthesized speech similar to the original speech is generated in case of analysis and synthesis.

As mentioned-above, in the second embodiment, by inputting a spectral envelope parameter (generated by the generation apparatus of the first embodiment) and a pitch mark sequence, pitch-cycle waveforms are generated and overlapped-added. As a result, a speech having high quality can be synthesized.

(The Third Embodiment)

A speech synthesis apparatus of the third embodiment is explained by referring to FIGS. 27~41.

Figure 27:
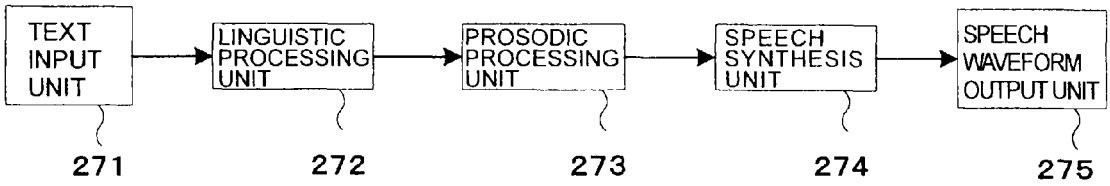
FIG. 27 is a block diagram of the speech synthesis apparatus according to a third embodiment.

FIG. 27 is a block diagram of the speech synthesis apparatus of the third embodiment. The speech synthesis apparatus includes a text input unit 271, a linguistic processing unit 272, a prosody processing unit 273, a speech synthesis unit 274, and a speech waveform output unit 275. A text is input, and a speech corresponding to the text is synthesized.

The linguistic processing unit 272 morphologically and syntactically analyzes a text input from the text input unit 271, and outputs the analysis result to the prosody processing unit 273. The prosody processing unit 273 processes accent and intonation from the analysis result, generates a phoneme sequence and prosodic information, and outputs them to the speech synthesis unit 274. The speech synthesis unit 274 generates a speech waveform from the phoneme sequence and prosodic information, and outputs the speech waveform via the speech waveform output unit 275.

Figure 28:
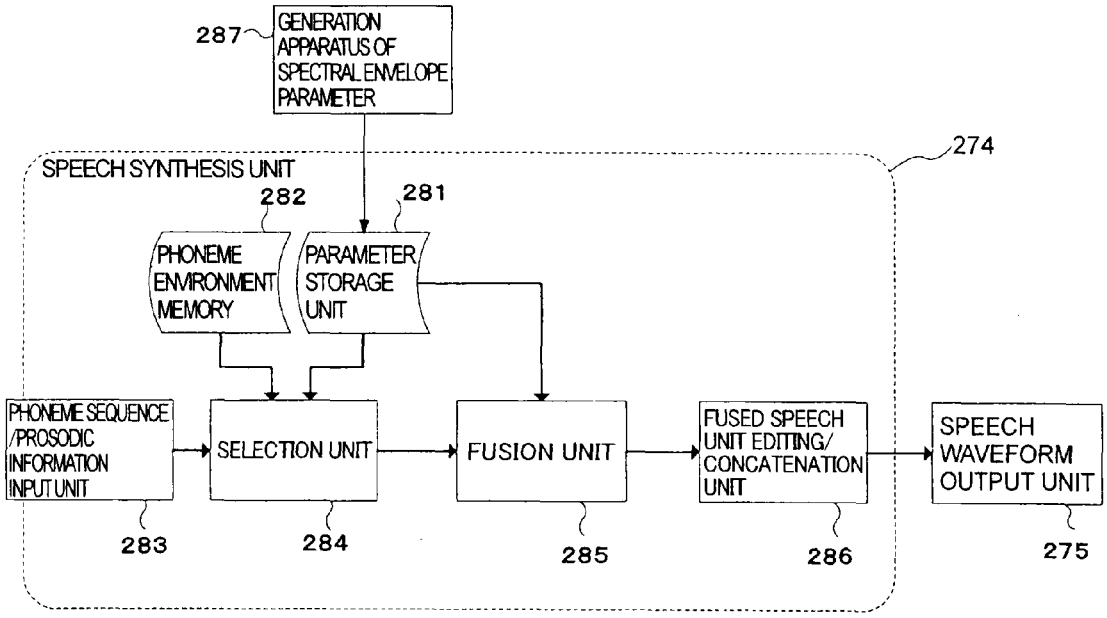
FIG. 28 is a block diagram of a speech synthesis unit in FIG. 27.

FIG. 28 is a block diagram of the speech synthesis unit 274 in FIG. 27. As shown in FIG. 28, the speech synthesis unit 274 includes a parameter storage 281, a phoneme environment memory 282, a phoneme sequence/prosodic information input unit 283, a selection unit 284, a fusion section 285, and a fused speech unit editing/concatenation unit 286.

The parameter storage unit 281 stores a large number of speech units. The speech unit environment memory 282, which functions as an attribute storage unit, stores phoneme environment information of each speech unit stored in the parameter storage unit 281. As information of the speech unit, a spectral environment parameter generated from the speech waveform by the generation apparatus of the first embodiment is stored. Briefly, the parameter storage unit 281 stores a speech unit as a synthesis unit used for generating a synthesized speech.

The synthesis unit is a combination of a phoneme or a divided phoneme, for example, a half-phoneme, a phone (C,V), a diphone (CV,VC,VV), a triphone (CVC,VCV), a syllable (CV,V) (V: vowel, C: consonant). These may be variable length as mixture.

The phoneme environment of the speech unit is information of environmental factor of the speech unit. The factor is, for example, a phoneme name, a previous phoneme, a following phoneme, a second following phoneme, a fundamental frequency, a phoneme duration, a stress, a position from accent core, a time from breath point, and an utterance speed.

The phoneme sequence/prosodic information input unit 283 inputs phoneme sequence/prosodic information, which is divided by a division unit, corresponding to the input text, which is output from the prosody processing unit 273. The prosodic information is a fundamental frequency and a phoneme duration. Hereinafter, the phoneme sequence/prosodic information input to the phoneme sequence/prosodic information input unit 283 is respectively called input phoneme sequence/input prosodic information. The input phoneme sequence is, for example, a sequence of phoneme symbols.

As to each synthesis unit of the input phoneme sequence, the plural speech units selection section 284 estimates a distortion of a synthesized speech based on input prosodic information and prosodic information included in the speech environment of speech units, and selects a plurality of speech units from the parameter storage unit 281 so that the distortion is minimized. The distortion of the synthesized speech is the sum of a target cost and a concatenation cost. The target cost is a distortion based on a difference between a phoneme environment of speech unit stored in the parameter storage unit 281 and a target phoneme environment from the phoneme sequence/prosodic information input unit 283. The concatenation cost is a distortion based on a difference between phoneme environments of two speech units to be concatenated.

Briefly, the "target cost" is a distortion occurred by using speech units (stored in the parameter storage unit 281) under the target phoneme environment of the input text. The "concatenation cost" is a distortion occurred from discontinuity of phoneme environment between two speech units to be concatenated. In the third embodiment, as the distortion of the synthesized speech, a cost function (explained hereafter) is used.

Next, the fusion unit 285 fuses a plurality of selected speech units, and generates a fused speech unit. In the third embodiment, fusion processing of speech units is executed using a spectral envelope parameter stored in the parameter storage unit 281. Then, the fused speech unit editing/concatenation section 286 transforms/concatenates a sequence of fused speech units based on the input prosodic information, and generates a speech waveform of a synthesized speech.

In case of smoothing a boundary of a fused speech unit, the fused speech unit editing/concatenation unit 286 smoothes the spectral envelope parameter of the fused speech unit. By using the spectral envelope parameter and a pitch mark (obtained from the input prosodic information), a synthesized speech is generated by speech waveform generation processing of the speech synthesis apparatus of the second embodiment. Last, the speech waveform is output by the speech waveform output unit 275.

Hereinafter, each processing of the speech synthesis unit 274 is explained in detail. In this case, a speech unit of a synthesis unit is a half-phoneme.

Figure 29:
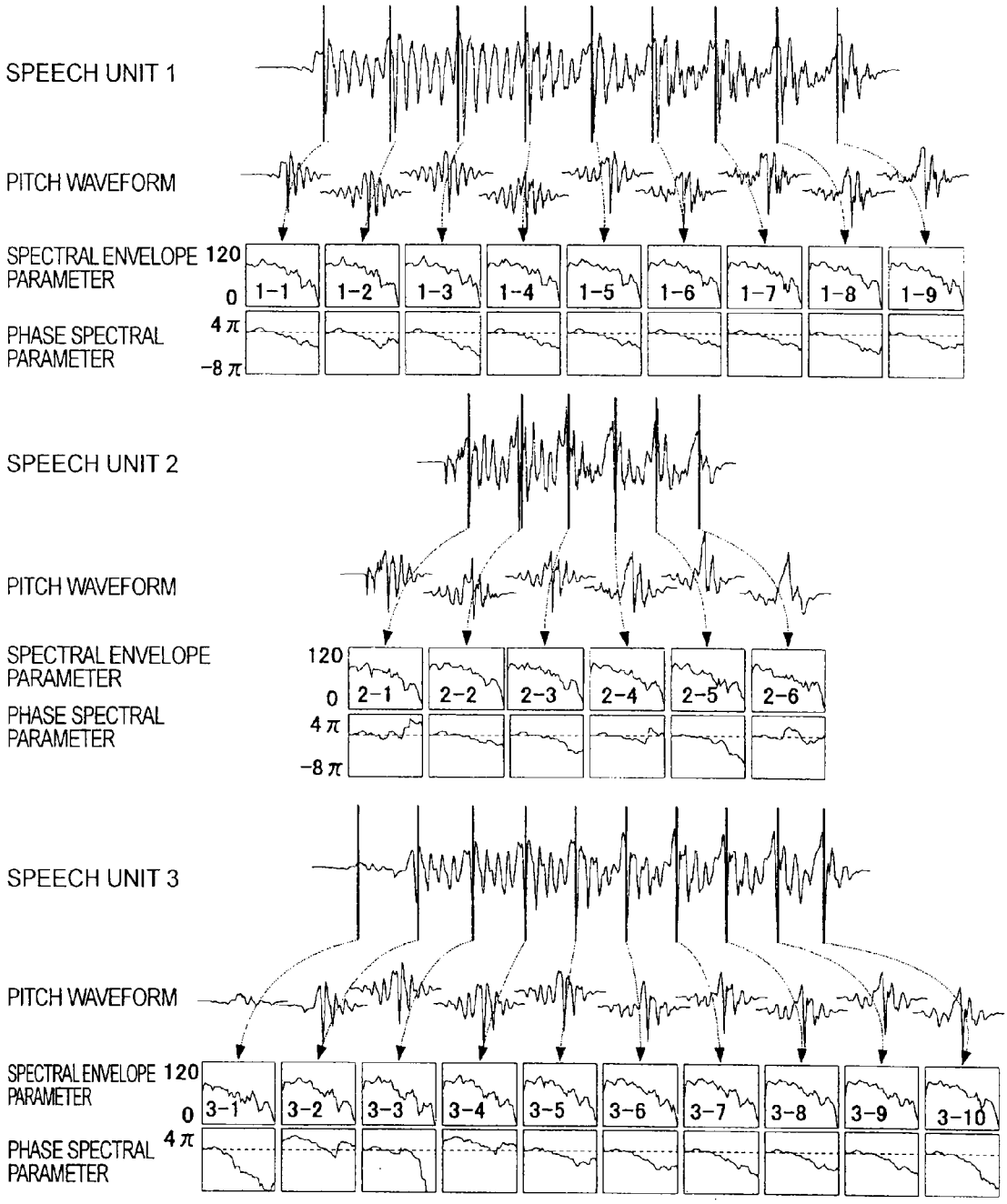
FIG. 29 is an exemplary generation of the spectral envelope parameter in the spectral envelope parameter generation apparatus.

As shown in FIG. 29, the generation apparatus 287 generates a spectral envelope parameter and a phase spectral parameter from a speech waveform of speech unit. In FIG. 29, with regard to three speech units 1, 2 and 3, a pitch-cycle waveform, a spectral envelope parameter, and a phase spectral parameter, are respectively shown. A number in a drawing of the spectral envelope parameter represents a pair of a unit number and a pitch mark number.

As shown in FIG. 30, the parameter storage unit 281 stores the spectral envelope parameter and the phase spectral parameter in correspondence with the speech unit number.

As shown in FIG. 31, the phoneme environment memory 282 stores phoneme environment information of each speech unit (stored in the parameter storage unit 281) in correspondence with the speech unit number. As the phoneme environment, a half-phoneme sign (phoneme name, right and left), a fundamental frequency, a phoneme duration, and a concatenation boundary cepstrum, are stored.

In this case, the speech unit is a half-phoneme unit. However, a phone, a diphone, a triphone, a syllable, or these combination having variable length, may be used.

With regard to each speech unit stored in the parameter storage unit 281, each phoneme of a large number of speech data (previously stored) is subjected to labeling, a speech waveform of each half-phoneme is extracted, and a spectral envelope parameter is generated from the speech waveform. The spectral envelope parameter is stored as the speech unit.

For example, FIG. 32 shows a result of labeling of each phoneme for speech data 321. In FIG. 32, as to speech data (speech waveform) of each phoneme separated by a label boundary 322, a phoneme sign is added as label data 323. Furthermore, from this speech data, phoneme environment information (for example, a phoneme name (phoneme sign), a fundamental frequency, a phoneme duration) of each phoneme is also extracted.

In this way, as to a spectral envelope parameter corresponding to each speech waveform (extracted from speech data 321) and a phoneme environment corresponding to the speech waveform, the same unit number is assigned. As shown in FIGS. 30 and 31, the spectral envelope parameter and the phoneme environment are respectively stored.

Next, a cost function used for selecting a speech unit sequence by the selection unit 284 is explained.

First, in case of generating a synthesized speech by modifying/concatenating speech units, a subcost function $C_n$ ($u_i$, $u_{i-1}$, $t_i$) (n:1, . . . N, N is the number of subcost function) is determined for each factor of distortion. Assume that a target speech corresponding to input phoneme sequence/prosodic information is "$t=(t_1, \ldots, t_I)$". In this case, "$t_i$" represents phoneme environment information as a target of speech unit corresponding to the i-th segment, and "$u_i$" represents a speech unit of the same phoneme as "$t_i$" among speech units stored in the parameter storage unit 281.

The subcost function is used for estimating a distortion between a target speech and a synthesized speech generated using speech units stored in the parameter storage unit 281. In order to calculate the cost, a target cost and a concatenation cost are used. The target cost is used for calculating a distortion between a target speech and a synthesized speech generated using the speech unit. The concatenation cost is used for calculating a distortion between the target speech and the synthesized speech generated by concatenating the speech unit with another speech unit.

As the target cost, a fundamental frequency cost and a phoneme duration cost are used. The fundamental frequency cost represents a difference of fundamental frequency between a target and a speech unit stored in the parameter storage unit 281. The phoneme duration cost represents a difference of phoneme duration between the target and the speech unit.

As the concatenation cost, a spectral concatenation cost representing a difference of spectrum at concatenation boundary is used.

The fundamental frequency cost is calculated as follows.

$$C_1(u_i,u_{i-1},t_i)=\{\log(f(v_i))-\log(f(t_i))\}^2 \tag{24}$$

$v_i$: unit environment of speech unit $u_i$ f: function to extract a fundamental frequency from unit environment $v_i$ The phoneme duration cost is calculated as follows.

$$C_2(u_i,u_{i-1},t_i)=\{g(v_i)-g(t_i)\}^2 \tag{25}$$

g: function to extract a phoneme duration from unit environment $v_i$

The spectral concatenation unit is calculated from a cepstrum distance between two speech units as follows.

$$C_3(u_i,u_{i-1},t_i)=\|h(u_i)-h(u_{i-1}) \tag{26}$$

||: norm h: function to extract cepstrum coefficient (vector) of concatenation boundary of speech unit $u_i$ A weighted sum of these subcost functions is defined as a synthesis unit cost function as follows.

$$C(u_i, u_{i-1}, t_i) = \sum_{n=1}^{N} w_n \cdot C_n(u_i, u_{i-1}, t_i) \tag{27}$$

$w_n$: weight between subcost functions

In order to simplify the explanation, all "$w_n$" is set to "1". The above equation (27) represents calculation of synthesis unit cost of a speech unit when the speech unit is applied to some synthesis unit.

As to a plurality of segments divided from an input phoneme sequence by a synthesis unit, the synthesis unit cost of each segment is calculated by equation (27). A (total) cost is calculated by summing the synthesis unit cost of all segments as follows.

$$\text{Cost} = \sum_{i=1}^{I} (C(u_i, u_{i-1}, t_i)) \tag{28}$$

In the selection unit 284, by using the cost functions (24) ~(28), a plurality of speech units is selected for one segment (one synthesis unit) by two steps.

Figure 33:
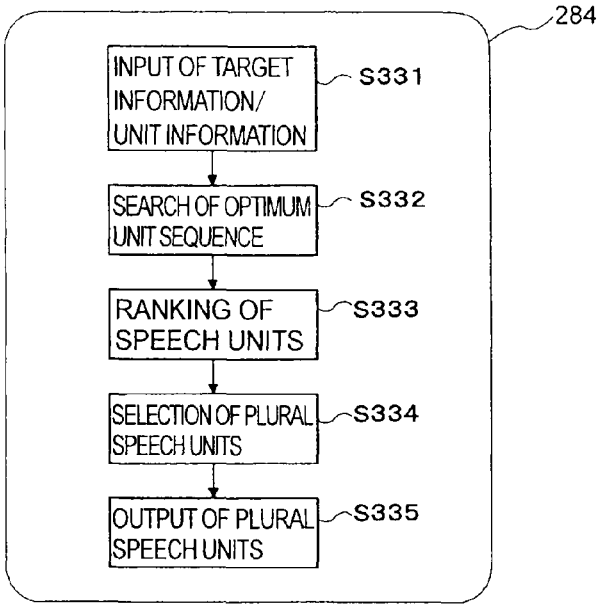
FIG. 33 is a flow chart of processing of a selection unit in FIG. 28.

FIG. 33 is a flow chart of processing of selection of the plurality of speech units.

First, at S331, target information representing a target of unit selection (such as phoneme/prosodic information of target speech) and phoneme environment information of speech unit (stored in the phoneme environment memory 282) are input.

At S332, as unit selection of the first step, a speech unit sequence having minimum cost value (calculated by the equation (28)) is selected from speech units stored in the parameter storage unit 281. This speech unit sequence (combination of speech units) is called "optimum unit sequence". Briefly, each speech unit in the optimum unit sequence corresponds to each segment divided from the input phoneme sequence by a synthesis unit. The synthesis unit cost (calculated by the equation (27)) of each speech unit in the optimum unit sequence and the total cost (calculated by the equation (28)) are smallest among any of other speech unit sequences. In this case, the optimum unit sequence is effectively searched using DP (Dynamic Programming) method.

Next, at S333 and S334, a plurality of speech units is selected for one segment using the optimum unit sequence. In this case, one of the segments is set to a notice segment.

Processing of S333 and S334 is repeated so that each of the segments is set to a notice segment. First, each speech unit in the optimum unit sequence is fixed to each segment except for the notice segment. Under this condition, as to the notice segment, speech units stored in the parameter storage unit 281 are ranked with the cost calculated by the equation (28).

At S333, among speech units stored in the parameter storage unit 281, a cost is calculated for each speech unit having the same phoneme name (phoneme sign) as a half-phoneme of the notice segment by using the equation (28). In case of calculating the cost for each speech unit, a target cost of the notice segment, a concatenation cost between the notice segment and a previous segment, and a concatenation cost between the notice segment and a following segment respectively vary. Accordingly, only these costs are taken into consideration in the following steps.

(Step 1) Among speech units stored in the parameter storage unit 281, a speech unit having the same half-phoneme name (phoneme sign) as a half-phoneme of the notice segment is set to a speech unit "$u_3$". A fundamental frequency cost is calculated from a fundamental frequency $f(v_3)$ of the speech unit $u_3$ and a target fundamental frequency $f(t_3)$ by the equation (24).

(Step 2) A phoneme duration cost is calculated from a phoneme duration $g(v_3)$ of the speech unit $u_3$ and a target phoneme duration $g(t_3)$ by the equation (25).

(Step 3) A first spectral concatenation cost is calculated from a cepstrum coefficient $h(u_3)$ of the speech unit $u_3$ and a cepstrum coefficient $h(u_2)$ of a previous speech unit $u_2$ by the equation (26). Furthermore, a second spectral concatenation cost is calculated from the cepstrum coefficient $h(u_3)$ of the speech unit $u_3$ and a cepstrum coefficient $h(u_4)$ of a following speech unit $u_4$ by the equation (26).

(Step 4) By calculating weighted sum of the fundamental frequency cost, the phoneme duration cost, and the first and second spectral concatenation costs, a cost of the speech unit $u_3$ is calculated.

(Step 5) As to each speech unit having the same half-phoneme name (phoneme sign) as a half-phoneme of the notice segment among speech units stored in the parameter storage unit 281, the cost is calculated by above steps 1~4. These speech units are ranked in order of smaller cost, i.e., the smaller a cost is, the higher a rank of the speech unit is. Then, at S334, speech units of NF units are selected in order of higher rank. Above steps 1~5 are repeated for each segment. As a result, speech units of NF units are respectively obtained for each segment.

In above-mentioned cost function, cepstrum distance is used as the spectral concatenation cost. However, by calculating a spectral distance from the spectral envelope parameter of a start point and an end point of a speech waveform of the speech unit (stored in the parameter storage unit 281), the spectral distance may be used as the spectral concatenation cost (the equation (26)). In this case, cepstrum need not be stored and a capacity of the phoneme environment memory becomes small.

(11) Next, the fusion unit 285 is explained. In the fusion unit 285, a plurality of speech units (selected by the selection unit 284) is fused, and a fused speech unit is generated. Fusion of speech units is generation of a representative speech unit from the plurality of speech units. In the third embodiment, this fusion processing is executed using the spectral envelope parameter obtained by the generation apparatus of the first embodiment.

As the fusion method, spectral envelope parameters are averaged for a low band part and a spectral envelope parameter selected is used for a high band part to generate a fused spectral envelope parameter. As a result, sound quality-fall and buzzy (occurred by averaging all bands) are suppressed.

Furthermore, in case of fusing on a temporal region (such as averaging pitch-cycle waveforms), non-coincidence of phases of the pitch-cycle waveforms badly affects on the fusion processing. However, in the third embodiment, by fusing using the spectral envelope parameter, the phases does not affect on the fusion processing, and the buzzy can be suppressed. In the same way, by fusing a phase spectral parameter, a fused spectral envelope parameter and a fused phase spectral parameter are output as a fused speech unit.

Figure 34:
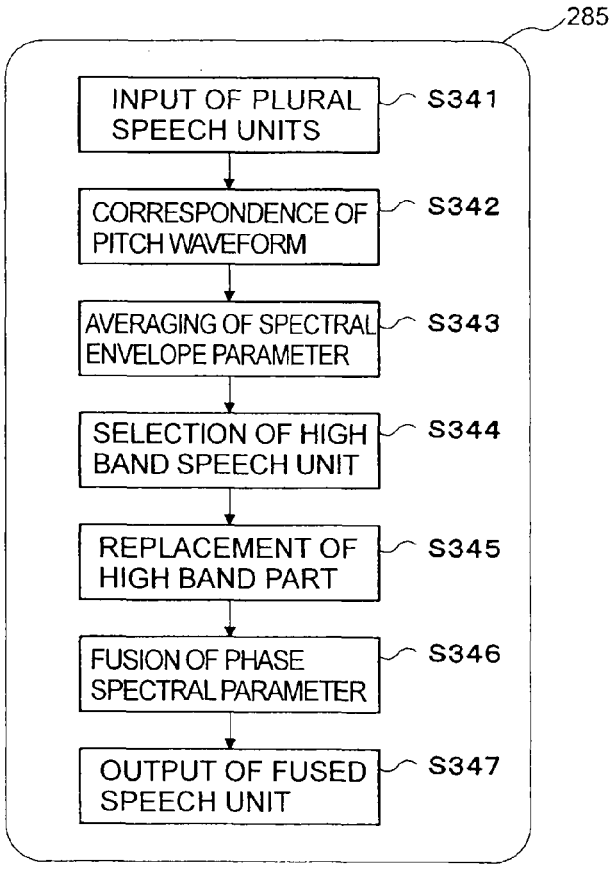
FIG. 34 is a flow chart of processing of a fusion unit in FIG. 28.

FIG. 34 shows a flow chart of processing of the fusion unit 285. First, at S341, a spectral envelope parameter and a phase spectral parameter of a plurality of speech units (selected by the selection unit 284) are input.

Next, at S342, a number of pitch-cycle waveforms of each speech unit is equalized to coincide with duration of a target speech unit to be synthesized. The number of pitch-cycle waveforms is set to be equal to a number of target pitch marks. The target pitch mark is generated from the input fundamental frequency and duration, which is a sequence of center time of pitch-cycle waveforms of a synthesized speech.

Figure 35:
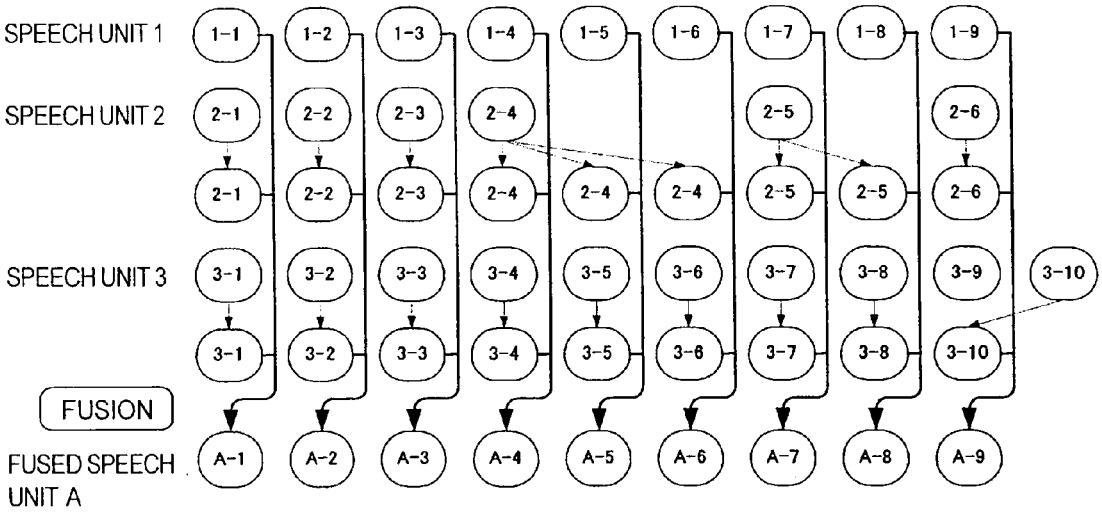
FIG. 35 is an exemplary processing of S342 in FIG. 34.

FIG. 35 shows a schematic diagram of correspondence processing of pitch-cycle waveforms of each speech unit. In FIG. 35, in case of synthesizing the left side speech of "A" (Japanese), three speech units 1, 2 and 3 are selected by the selection unit 284.

As shown in FIG. 9, the number of target pitch marks is nine, and three speech units 1, 2 and 3 respectively includes nine pitch-cycle waveforms, six pitch-cycle waveforms, and ten pitch-cycle waveforms. At S342, in order for the number of pitch-cycle waveforms of each speech unit to equally coincide with the number of target pitch marks, any pitch-cycle waveform is copied or deleted. As to the speech unit 1, the number of pitch-cycle waveforms is equal to the number of target pitch marks. Accordingly, these pitch-cycle waveforms are used as it is. As to the speech unit 2, by copying the fourth and fifth pitch-cycle waveforms, the number of pitch-cycle waveforms is equal to nine. As to the speech unit 3, by deleting the ninth pitch-cycle waveform, the number of pitch-cycle waveforms is equal to nine.

After equalizing the number of pitch-cycle waveforms of each speech unit, spectral parameters of corresponding pitch-cycle waveforms of each speech unit are fused. Briefly, in FIG. 35, from spectral parameters of corresponded pitch-cycle waveforms, each spectral parameter A-1~A-9 of a fused speech unit A is generated.

Figure 36:
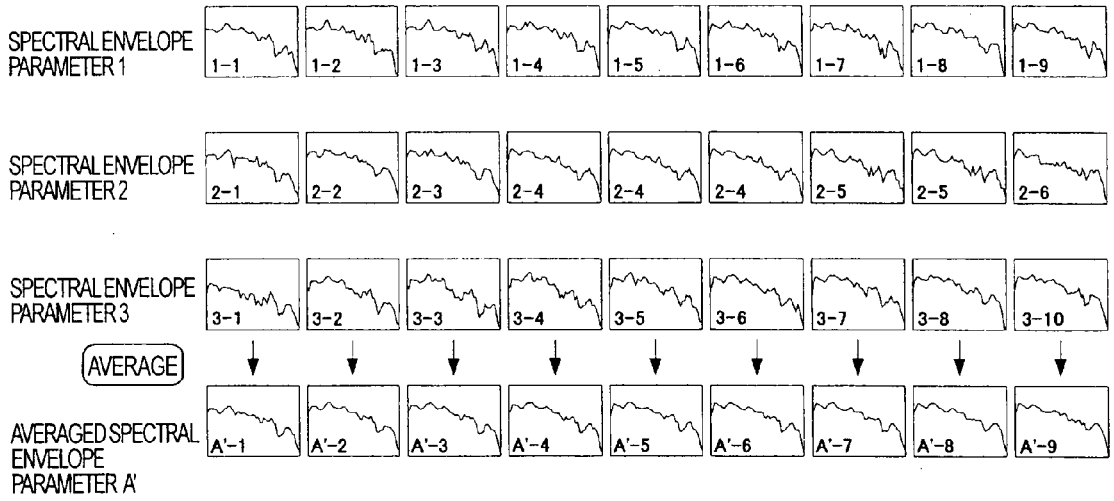
FIG. 36 is an exemplary processing of S343 in FIG. 34.

Next, at S343, spectral envelope parameters of corresponded pitch-cycle waveforms of each speech unit are averaged. FIG. 36 shows a schematic diagram of average processing of the spectral envelope parameters. As shown in FIG. 36, by averaging each dimensional value of spectral envelope parameters 1, 2 and 3, an averaged spectral envelope parameter A' is calculated as follows.

$$c'(t) = \frac{1}{N_F}\sum_{i=1}^{N_F} c_i(t) \tag{29}$$

c'(t): averaged spectral envelope parameter $c_i(t)$: spectral envelope parameter of i-th speech unit $N_F$: the number of speech units to be fused In the equation (29), dimensional values of each spectral envelope parameter are directly averaged. However, the dimensional values may be raised to n-th power, and averaged to generate the root of n-th power. Furthermore, the dimensional values may be averaged by an exponent to generate a logarithm, or averaged by weighting each spectral envelope parameter. In this way, at S343, the averaged spectral envelope parameter is calculated from spectral envelope parameter of each speech unit.

Next, at S344, one speech unit having a spectral envelope parameter nearest to the averaged spectral envelope parameter is selected from the plurality of speech units. Briefly, a distortion between the averaged spectral envelope parameter and a spectral envelope parameter of each speech unit is calculated, and one speech unit having the smallest distortion is selected. As the distortion, a squared error of spectral envelope parameter is used. By calculating an averaged distortion of spectral envelope parameters of all pitch-cycle waveforms of the speech unit, one speech unit to minimize the averaged distortion is selected. In FIG. 36, the speech unit 1 is selected as one speech unit having the minimum of squared error from the averaged spectral envelope parameter.

At S345, a high band part of the averaged spectral envelope parameter is replaced with a spectral envelope parameter of the one speech unit selected at S344. As the replacement processing, first, a boundary frequency (boundary order) is extracted. The boundary frequency is determined based on an accumulated value of amplitude from the low band.

In this case, first, the accumulated value $cum_j(t)$ of amplitude spectrum is calculated as follows.

$$cum_j(t) = \sum_{p=0}^{N} \sqrt{\exp(c_j^p(t))} \tag{30}$$

$c_j^p(t)$: spectral envelope parameter (converted from logarithm spectral domain to amplitude spectral domain)

t: pitch mark number j: unit number p: dimension

N: the number of dimension of spectral envelope parameter

After calculating the accumulated value of all orders, by using a predetermined ratio λ, the largest order q which the accumulated value from the low band is smaller than $\lambda \cdot cum_j(t)$ is calculated as follows.

$$q = \underset{p}{\operatorname{argmax}} \left\{ \sum_{p=0}^{P} \sqrt{\exp(c_j^p(t)} < \lambda \cdot cum_j(t) \right\} \tag{31}$$

By using the equation (31), the boundary frequency is calculated based on the amplitude. In this case, assume that "λ=0.97". For example, λ may be set as a small value for a voiced friction sound to obtain a boundary frequency. In this embodiment, order (27, 27, 31, 32, 35, 31, 31, 28, 38) is selected as the boundary frequency.

Next, by actually replacing the high band, a fused spectral envelope parameter is generated. In case of mixing, a weight is determined so that spectral envelope parameter of each dimension smoothly changes by width of ten points, and two spectral envelope parameters of the same dimension are mixed by weighted sum.

Figure 37:
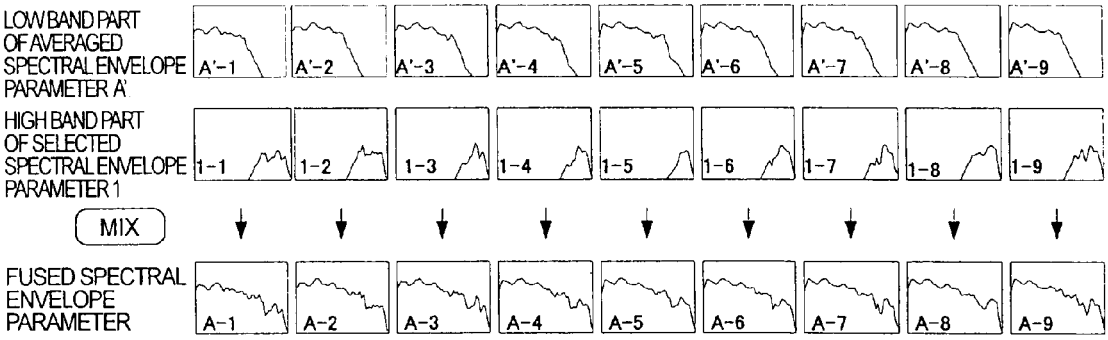
FIG. 37 is an exemplary processing of S345 in FIG. 34.

FIG. 37 shows an exemplary replacement of high band of the selected spectral envelope parameter with the averaged spectral envelope parameter.

As shown in FIG. 37, by mixing a low band part of the averaged spectral envelope parameter A' with a high band part of spectral envelope parameter of the selected speech unit 1, a fused spectral envelope parameter is obtained. In this case, the averaged spectral envelope parameter A' has a smooth high band part. Accordingly, the fused spectral envelope parameter has a natural high band (a mountain and a valley of spectrum). In this way, the fused spectral envelope parameter is obtained.

Briefly, the fused spectral envelope parameter has stability because the averaged low band part is used. Furthermore, the fused spectral envelope parameter maintains naturalness because information of selected speech unit is used as the high band part.

Next, at S346, in the same way as the spectral envelope parameter, a fused phase spectral parameter is generated from a plurality of phase spectral parameter selected. In the same way as the fused spectral envelope parameter, the plurality of phase spectral parameter is fused by averaging and replacing a high band. In case of fusing the plurality of phase spectral parameter, each phase of the plurality of phase spectral parameter is unwrapped, an averaged phase spectral parameter is calculated from a plurality of unwrapped phase spectral parameters, and the fused phase spectral parameter is generated from the averaged phase spectral parameter by replacing the high band.

Figure 38:
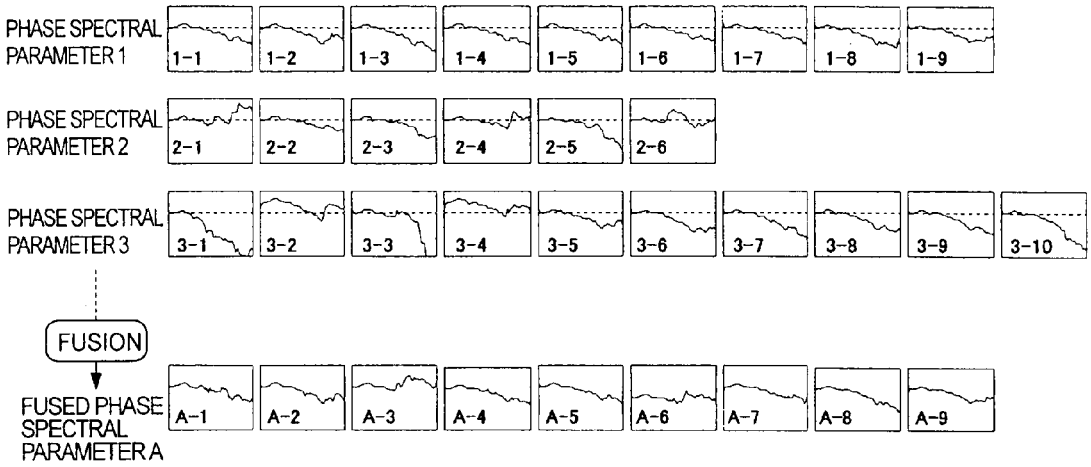
FIG. 38 is an exemplary processing of S346 in FIG. 34.

FIG. 38 shows an exemplary fusion of three phase spectral parameters. In the same way as fusion of the spectral envelope parameter, a number of pitch-cycle waveforms of each speech unit is equalized. As to a phase spectral parameter corresponding to a pitch mark of each pitch-cycle waveform, averaging and high band-replacement are executed.

Generation of fused phase spectral parameter is not limited to averaging and high band-replacement, and another generation method may be used. For example, an averaged phase spectral parameter of each phoneme is generated from a plurality of phase spectral parameter of each phoneme, and an interval between each center of two adjacent phonemes of the averaged phase spectral parameter is interpolated. Furthermore, as to the averaged phase spectral parameter of which interval between each center of two adjacent phonemes is interpolated, a high band part of each phoneme is replaced with a high band part of a phase spectral parameter selected at each pitch mark position.

Accordingly, as to the fused phase spectral parameter, a low band part has smoothness (few discontinuity) and a high band part has naturalness.

At S347, by outputting the fused spectral envelope parameter and the fused phase spectral parameter, a fused speech unit is generated. In this way, as to the spectral envelope parameter obtained by the generation apparatus of the first embodiment, processing such as high band-replacement can be easily executed. Briefly, this parameter is suitable for speech synthesis of plural unit selection and fusion type.

Next, with regard to the fused speech unit editing/concatenating unit 286, smoothing is subjected to a unit boundary of the spectral parameter. In the same way as the speech synthesis apparatus of the second embodiment, a pitch-cycle waveform is generated from the spectral parameter. By overlapping and adding the pitch-cycle waveforms centering the pitch mark position (inputted), a speech waveform is generated.

Figure 39:
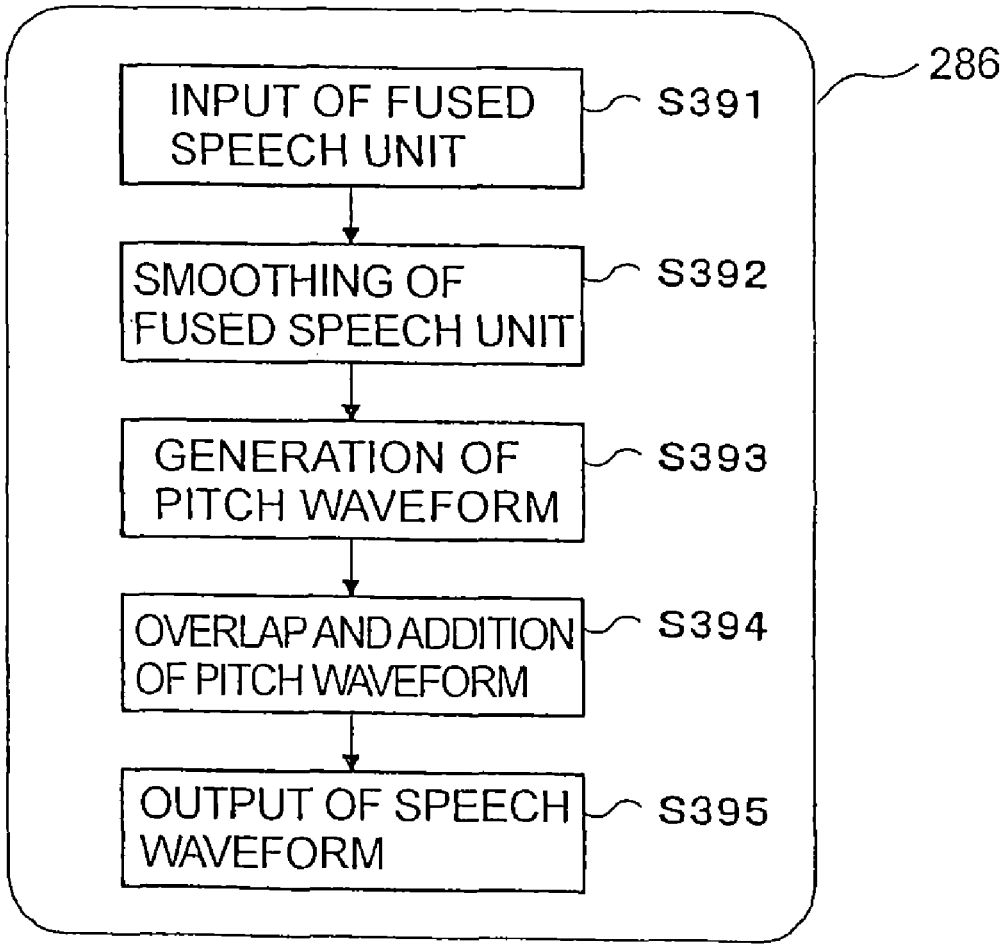
FIG. 39 is a flow chart of processing of a fused speech unit editing/concatenation unit in FIG. 28.

FIG. 39 shows a flow chart of processing of the fused speech unit editing/concatenating unit 286. The processing includes a step S391 to input a fused speech unit (generated by the fusion unit 285), a step S392 to smooth the fused speech unit at a concatenation boundary of adjacent speech units, a step S393 to generate a pitch-cycle waveform from a spectral parameter of the fused speech unit, a step S394 to overlap and add the pitch-cycle waveforms to match a pitch mark, and a step S395 to output a speech waveform obtained.

At S392, smoothing is subjected to a boundary between two adjacent units. The smoothing of the fused spectral envelope parameter is executed by weighted sum of fused spectral envelope parameters at edge point between two adjacent units. Concretely, a number of pitch-cycle waveforms "len" used for smoothing is determined, and smoothing is executed by interpolation of straight line as follows.

$$c'(t) = w(t)c(t) + (1 - w(t))c_{adj}(t) \tag{32}$$

$$w(t) = \frac{t+1}{len+1} * 0.5 + 0.5$$

c'(t): fused spectral envelope parameter smoothed c(t): fused spectral envelope parameter $c_{adj}(t)$: fused spectral envelope parameter at edge point between two adjacent units w: smoothing weight t: distance from concatenation boundary In the same way, smoothing of phase spectral parameter is also executed. In this case, the phase may be smoothed after unwrapping along a temporal direction. Furthermore, another smoothing method such as not weighted straight line but spline smoothing may be used.

As mentioned-above, as to the spectral envelope parameter of the first embodiment, each dimension represents information of the same frequency band. Accordingly, without correspondence processing among parameters, smoothing can be directly executed to each dimensional value.

Next, at S393, pitch-cycle waveforms are generated from the spectral envelope parameter and the phase spectral parameter (each smoothed), and the pitch-cycle waveforms are overlapped and added to match a target pitch mark. These processing are executed by the speech synthesis apparatus of the second embodiment.

Actually, a spectrum is regenerated from the spectral envelope parameter and the phase spectral parameter (each fused and smoothed), and a pitch-cycle waveform is generated from the spectrum by the inverse-Fourier transform using the equation (23). In order to avoid discontinuity, after the inverse-Fourier transform, a short window may be multiplied with a start point and an end point of the pitch-cycle waveform. In this way, the pitch-cycle waveforms are generated. By overlapping and adding the pitch waveforms to match the target pitch mark, a speech waveform is obtained.

Figure 40:
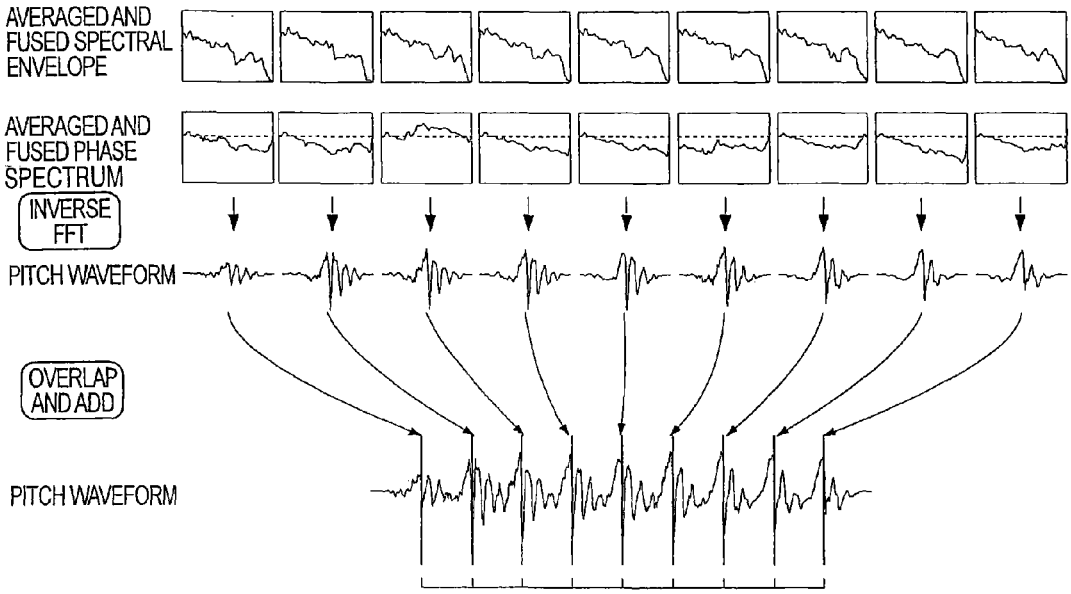
FIG. 40 is an exemplary processing of the fused speech unit editing/concatenation unit in FIG. 28.

FIG. 40 shows an exemplary processing of the fused speech unit editing/concatenation unit 286. In FIG. 40, the upper part is a logarithm spectral envelope generated from (fused and smoothed) logarithm spectral envelope by the equation (2), the second upper part is a phase spectrum generated from (fused and smoothed) phase spectrum by the equation (15), the third upper part is a pitch-cycle waveform generated from the logarithm spectral envelope and the phase spectrum by inverse-Fourier transform using the equation (23), and the lower part is a speech waveform obtained by overlapping and adding the pitch-cycle waveforms at a pitch mark position.

By above processing, in speech synthesis of plural unit selection and fusion type, a speech waveform corresponding to an arbitrary text is generated using the spectral envelope parameter and the phase spectral parameter based on the first embodiment.

The above processing represents speech synthesis for a waveform of voiced speech. In case of a segment of unvoiced speech, duration of each waveform of unvoiced speech is transformed, and waveforms are concatenated to generate a speech waveform. In this way, the speech waveform output unit 275 outputs the speech waveform.

Figure 41:
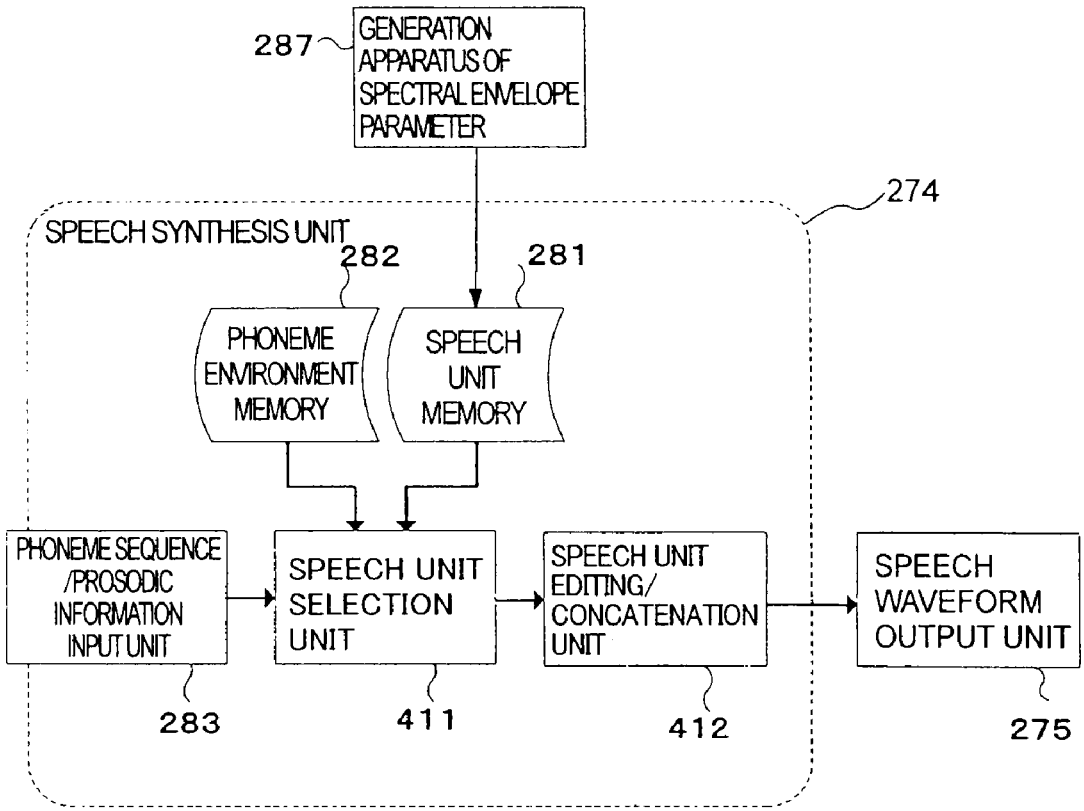
FIG. 41 is a block diagram of an exemplary modification of the speech synthesis apparatus according to the third embodiment.

Next, a modification of the speech synthesis apparatus of the third embodiment is explained by referring to FIG. 41. The above-mentioned speech synthesis apparatus is based on plural unit selection and fusion method. However, the speech synthesis apparatus is not limited to this method. In the modification, speech units are suitably selected, and prosodic transformation and concatenation are subjected to the selected speech units. Briefly, a speech synthesis apparatus of this modification is based on the unit selection method.

As shown in FIG. 41, in comparison with the speech synthesis apparatus of FIG. 28, the selection unit 284 is replaced with a speech unit selection unit 411, processing of the fusion unit 285 is removed, and the fused speech unit editing/concatenation unit 286 is replaced with a speech unit editing/concatenation unit 412.

In the speech unit selection unit 411, an optimized speech unit is selected for each segment, and selected speech units are supplied to the speech unit editing/concatenation unit 412. In the same way as S332 of the selection unit 284, the optimized speech unit is obtained by determining an optimized sequence of speech units.

In the speech unit editing/concatenation unit 412, speech units are smoothed, pitch-cycle waveforms are generated, and the pitch-cycle waveforms are overlapped and added to synthesize speech data. In this case, by smoothing using a spectral envelope parameter obtained by the generation apparatus of the first embodiment, the same processing as S392 of the fused speech unit editing/concatenation unit 286 is executed. Accordingly, high quality-smoothing can be executed.

Furthermore, in the same way as S393~S395, pitch-cycle waveforms are generated using the smoothed spectral envelope parameter. By overlapping and adding the pitch-cycle waveforms, speech data is synthesized. As a result, in the speech synthesis apparatus of unit selection type, the speech adaptively smoothed can be synthesized.

In the above embodiments, a logarithm spectral envelope is used as spectral envelope information. However, amplitude spectrum or a power spectrum may be used as the spectral envelope information.

As mentioned-above, in the third embodiment, by using the spectral envelope parameter obtained by the generation apparatus of the first embodiment, averaging of spectral parameter, replacement of high band, and smoothing of spectral parameter, can be adequately executed. Furthermore, by using characteristic to easily execute processing corresponding to the band, a synthesized speech having high quality can be effectively generated.

In the disclosed embodiments, the processing can be performed by a computer program stored in a computer-readable medium.

In the embodiments, the computer readable medium may be, for example, a magnetic disk, a flexible disk, a hard disk, an optical disk (e.g., CD-ROM, CD-R, DVD), an optical magnetic disk (e.g., MD). However, any computer readable medium, which is configured to store a computer program for causing a computer to perform the processing described above, may be used.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and soon. In short, the equipment and the apparatus that can execute the functions in embodiments using the program are generally called the computer.

Other embodiments of the invention will be apparent to those skilled in the art from consideration of the specification and embodiments of the invention disclosed herein. It is intended that the specification and embodiments be considered as exemplary only, with the scope and spirit of the invention being indicated by the claims.

What is claimed is:

1. An apparatus for speech processing, the apparatus being implemented by a computer programmed to execute computer-readable instructions stored in a memory, the apparatus comprising:

a frame extraction unit configured to extract, using the computer, a speech signal in each frame;

an information extraction unit configured to extract, using the computer, spectral envelope information of L-dimension from each frame by discrete Fourier transform, the spectral envelope information being represented by L points;

a basis generation unit configured to extract, using the computer, the spectral envelope information from the speech signal to generate a basis, to minimize a first evaluation function by changing the basis and a corresponding coefficient, the first evaluation being a sum of an error term and a first regularization term, the error term being a distortion between the spectral envelope information and a linear combination of the basis with the coefficient, the first regularization term being a sparseness of the coefficient, the sparseness being a smaller value when the coefficient is closer to zero, and to select the basis for which the first evaluation function is minimized;

a basis storage unit configured to store N bases (L>N>1), each basis having a different frequency band having a maximum as a peak frequency in a spectral domain having L-dimension, a value corresponding to a frequency outside the frequency band along a frequency axis of the spectral domain being zero, and two frequency bands of which two peak frequencies are adjacent along the frequency axis partially overlapping; and a parameter calculation unit configured to minimize, using the computer, a distortion between the spectral envelope information and a linear combination of each basis with the coefficient for each of L points of the spectral envelope information by changing the coefficient, and to set the coefficient of each basis for which the distortion is minimized as a spectral envelope parameter of the spectral envelope information.

2. The apparatus according to claim 1, further comprising:

a basis generation unit configured to determine a plurality of peak frequencies in the spectral domain, to create a unimodal window function having a length as an interval between two adjacent peak frequencies and having all zero frequency outside three adjacent peak frequencies along the frequency axis, and to set a shape of the window function to the basis.

3. The apparatus according to claim 2, wherein the basis generation unit is configured to determine the peak frequency having a wider interval than an adjacent peak frequency when the frequency is higher along the frequency axis.

4. The apparatus according to claim 2, wherein the basis generation unit is configured to determine the peak frequency having a wider interval than an adjacent peak frequency when the frequency is higher along the frequency axis as for a frequency band lower than a boundary frequency on the frequency axis, and to determine the peak frequency having an equal interval from the adjacent peak frequency as for a frequency band higher than the boundary frequency.

5. The apparatus according to claim 1, wherein the basis generation unit is configured to minimize a second evaluation function by changing the basis and the coefficient, the second evaluation function being the sum of the error term, the first regularization term, and a second regularization term, the second regularization term being a concentration degree at a position to a center of the basis, the concentration degree being a larger value when a value at the position distant from the center of the basis is larger, and to select the basis for which the second evaluation function is minimized.

6. The apparatus according to claim 1, wherein the parameter calculation unit is configured to minimize the distortion, wherein the distortion is a squared error between the spectral envelope information and a linear combination of each basis with the coefficient corresponding to each basis.

7. The apparatus according to claim 1, wherein the parameter calculation unit is configured to minimize the distortion under a constraint that the coefficient is non-negative.

8. The apparatus according to claim 1, wherein the parameter calculation unit is configured to assign a number of quantized bits to each dimension of the spectral envelope parameter, to determine a number of quantization bits to each dimension of the spectral envelope parameter, and to quantize the spectral envelope parameter based on the number of quantized bits and the number of quantization bits.

9. The apparatus according to claim 1, wherein the spectral envelope information is one of a logarithm spectral envelope, a phase spectrum, an amplitude spectral envelope, and a power spectral envelope.

10. An apparatus for a speech synthesis, the apparatus being implemented by a computer programmed to execute computer-readable instructions stored in a memory, the apparatus comprising:

a parameter storage unit configured to store the spectral envelope parameter corresponding to a pitch-cycle waveform of each speech unit;

an attribute storage unit configured to store an attribute information of each speech unit;

a division unit configured to divide, using the computer, a phoneme sequence of input text into each synthesis unit;

a selection unit configured to select, using the computer, at least one speech unit corresponding to each synthesis unit by using the attribute information;

an acquisition unit configured to acquire the spectral envelope parameter corresponding to the pitch-cycle waveform of each speech unit selected by the selection unit, the spectral envelope parameter having L-dimension;

a fusion unit configured to fuse, using the computer, a plurality of spectral envelope parameters to one spectral envelope parameter, when the acquisition unit acquires the plurality of spectral envelope parameters corresponding to pitch-cycle waveforms of a plurality of selected speech units by the selection unit;

a basis storage unit configured to store N bases (L>N>1), each basis having a different frequency band having a maximum as a peak frequency in a spectral domain having L-dimension, a value corresponding to a frequency outside the frequency band along a frequency axis of the spectral domain being zero, and two frequency bands of which two peak frequencies are adjacent along the frequency axis partially overlapping;

an envelope generation unit configured to generate spectral envelope information by linearly combining the bases with the spectral envelope parameter, the spectral envelope information being represented by L points;

a pitch-cycle waveform generation unit configured to generate a plurality of pitch-cycle waveforms by inverse-Fourier transform with a spectrum of the spectral envelope information; and a speech generation unit configured to generate a plurality of speech units by overlapping and adding the plurality of pitch-cycle waveforms, and to generate a speech waveform by concatenating the plurality of speech units, wherein the fusion unit is configured to correspond the spectral envelope parameter of each speech unit along a temporal direction, to average corresponded spectral envelope parameters to generate an averaged spectral envelope parameter, to select one representative speech unit from the plurality of speech units, and to set the spectral envelope parameter of the one representative speech unit as a representative spectral envelope parameter, to determine a boundary order from the representative spectral envelope parameter or the averaged spectral envelope parameter, and to mix the plurality of spectral envelope parameters by using the averaged spectral envelope parameter for a spectral envelope parameter having lower order than the boundary order and by using the representative spectral envelope parameter for a spectral envelope parameter having higher order than the boundary order.

11. A method for speech processing, the method using a computer to execute computer-readable instructions stored in a memory, the method comprising:

dividing a speech signal into each frame;

extracting spectral envelope information of L-dimension from each frame by discrete Fourier transform, the spectral envelope information being represented by L points;

extracting the spectral envelope information from the speech signal to generate a basis;

minimizing a first evaluation function by changing the basis and a corresponding coefficient, the first evaluation being a sum of an error term and a first regularization term, the error term being a distortion between the spectral envelope information and a linear combination of the basis with the coefficient, the first regularization term being a sparseness of the coefficient, the sparseness being a smaller value when the coefficient is closer to zero;

selecting the basis for which the first evaluation function is minimized;

storing N bases (L>N>1) in a memory, each basis having a different frequency band having a maximum as a peak frequency in a spectral domain having L-dimension, a value corresponding to a frequency outside the frequency band along a frequency axis of the spectral domain being zero, and two frequency bands of which two peak frequencies are adjacent along the frequency axis partially overlapping;

minimizing, by the computer, a distortion between the spectral envelope information and a linear combination of each basis with the coefficient for each of L points of the spectral envelope information by changing the coefficient; and setting the coefficient of each basis for which the distortion is minimized as a spectral envelope parameter of the spectral envelope information.

12. A method for speech synthesis, the method using a computer to execute computer-readable instructions stored in a memory, the method comprising:

storing a spectral envelope parameter corresponding to a pitch-cycle waveform of each speech unit;

storing an attribute information of each speech unit;

dividing a phoneme sequence of input text into each synthesis unit;

selecting at least one speech unit corresponding to each synthesis unit by using the attribute information;

acquiring the spectral envelope parameter corresponding to the pitch-cycle waveform of each speech unit selected, the spectral envelope parameter having L-dimension;

fusing a plurality of spectral envelope parameters to one spectral envelope parameter, when the plurality of spectral envelope parameters corresponding to pitch-cycle waveforms of a plurality of selected speech units is acquired;

storing N bases (L>N>1) in a memory, each basis having a different frequency band having a maximum as a peak frequency in a spectral domain having L-dimension, a value corresponding to a frequency outside the frequency band along a frequency axis of the spectral domain being zero, and two frequency bands of which two peak frequencies are adjacent along the frequency axis partially overlapping:

generating spectral envelope information by linearly combining the bases with the spectral envelope parameter, the spectral envelope information being represented by L points;

generating, by the computer, a plurality of pitch-cycle waveforms by inverse-Fourier transform with a spectrum of the spectral envelope information;

generating a plurality of speech units by overlapping and adding the plurality of pitch-cycle waveforms; and generating a speech waveform by concatenating the plurality of speech units, wherein the fusing step further comprises corresponding the spectral envelope parameter of each speech unit along a temporal direction;

averaging corresponded spectral envelope parameters to generate an averaged spectral envelope parameter;

selecting one representative speech unit from the plurality of speech units;

setting the spectral envelope parameter of the one representative speech unit as a representative spectral envelope parameter;

determining a boundary order from the representative spectral envelope parameter or the averaged spectral envelope parameter; and mixing the plurality of spectral envelope parameters by using the averaged spectral envelope parameter for a spectral envelope parameter having lower order than the boundary order and by using the representative spectral envelope parameter for a spectral envelope parameter having higher order than the boundary order.

13. A non-transitory computer-readable medium storing a computer program for causing a computer to perform a method for a speech processing, the method comprising:

dividing a speech signal into each frame;

extracting a spectral envelope information of L-dimension from each frame by discrete Fourier transform, the spectral envelope information being represented by L points;

extracting the spectral envelope information from the speech signal to generate a basis;

minimizing a first evaluation function by changing the basis and a corresponding coefficient, the first evaluation being a sum of an error term and a first regularization term, the error term being a distortion between the spectral envelope information and a linear combination of the basis with the coefficient, the first regularization term being a sparseness of the coefficient, the sparseness being a smaller value when the coefficient is closer to zero;

selecting the basis for which the first evaluation function is minimized;

storing N bases (L>N>1) in a memory, each basis having a different frequency band having a maximum as a peak frequency in a spectral domain having L-dimension, a value corresponding to a frequency outside the frequency band along a frequency axis of the spectral domain being zero, and two frequency bands of which two peak frequencies are adjacent along the frequency axis partially overlapping;

minimizing a distortion between the spectral envelope information and a linear combination of each basis with the coefficient for each of L points of the spectral envelope information by changing the coefficient; and setting the coefficient of each basis for which the distortion is minimized as a spectral envelope parameter of the spectral envelope information.

14. A non-transitory computer-readable medium storing a computer program for causing a computer to perform a method for speech synthesis, the method comprising:

storing a spectral envelope parameter corresponding to a pitch-cycle waveform of each speech unit;

storing an attribute information of each speech unit;

dividing a phoneme sequence of input text into each synthesis unit;

selecting at least one speech unit corresponding to each synthesis unit by using the attribute information;

acquiring the spectral envelope parameter corresponding to the pitch-cycle waveform of each speech unit selected, the spectral envelope parameter having L-dimension;

fusing a plurality of spectral envelope parameters to one spectral envelope parameter, when the plurality of spectral envelope parameters corresponding to pitch-cycle waveforms of a plurality of selected speech units is acquired;

storing N bases (L>N>1) in a memory, each basis having a different frequency band having a maximum as a peak frequency in a spectral domain having L-dimension, a value corresponding to a frequency outside the frequency band along a frequency axis of the spectral domain being zero, and two frequency bands of which two peak frequencies are adjacent along the frequency axis partially overlapping:

generating spectral envelope information by linearly combining the bases with the spectral envelope parameter, the spectral envelope information being represented by L points;

generating a plurality of pitch-cycle waveforms by inverse-Fourier transform with a spectrum of the spectral envelope information;

generating a plurality of speech units by overlapping and adding the plurality of pitch-cycle waveforms; and generating a speech waveform by concatenating the plurality of speech units, wherein the fusing step further comprises corresponding the spectral envelope parameter of each speech unit along a temporal direction;

averaging corresponded spectral envelope parameters to generate an averaged spectral envelope parameter;

selecting one representative speech unit from the plurality of speech units;

setting the spectral envelope parameter of the one representative speech unit as a representative spectral envelope parameter;

determining a boundary order from the representative spectral envelope parameter or the averaged spectral envelope parameter; and mixing the plurality of spectral envelope parameters by using the averaged spectral envelope parameter for a spectral envelope parameter having lower order than the boundary order and by using the representative spectral envelope parameter for a spectral envelope parameter having higher order than the boundary order.

* * * * *